US010239224B2

(12) United States Patent
Aylsworth

(10) Patent No.: US 10,239,224 B2
(45) Date of Patent: Mar. 26, 2019

(54) LUMBER RETRIEVAL METHOD WITH SELECTIVE CROWN ORIENTATION

(71) Applicant: Steven L. Aylsworth, Chatfield, MN (US)

(72) Inventor: Steven L. Aylsworth, Chatfield, MN (US)

( * ) Notice: Subject to any disclaimer, the term of this patent is extended or adjusted under 35 U.S.C. 154(b) by 311 days.

(21) Appl. No.: 15/350,041

(22) Filed: Nov. 12, 2016

(65) Prior Publication Data

US 2017/0057113 A1 Mar. 2, 2017

Related U.S. Application Data

(60) Continuation-in-part of application No. 15/331,824, filed on Oct. 22, 2016, which is a continuation-in-part of application No. 14/577,779, filed on Dec. 19, 2014, which is a division of application No. 13/136,922, filed on Aug. 15, 2011, now Pat. No. 8,960,244.

(60) Provisional application No. 61/402,654, filed on Sep. 2, 2010, provisional application No. 62/324,151, filed on Apr. 18, 2016.

(51) Int. Cl.
*B27B 31/00* (2006.01)
*B27B 31/04* (2006.01)

(52) U.S. Cl.
CPC ..... *B27B 31/00* (2013.01); *B27B 31/04* (2013.01)

(58) Field of Classification Search
CPC ..... B27M 1/00; B27M 1/08; B27B 1/007
See application file for complete search history.

(56) References Cited

U.S. PATENT DOCUMENTS

| | | | |
|---|---|---|---|
| 561,715 | A | 6/1896 | Lynch |
| 2,730,144 | A | 1/1956 | Joa |
| 3,116,835 | A | 1/1964 | Brandon |
| 3,254,764 | A | 7/1966 | Boyle |
| 3,272,044 | A | 9/1966 | Obenshain |
| 3,873,000 | A | 3/1975 | Eaton et al. |

(Continued)

FOREIGN PATENT DOCUMENTS

| | | | |
|---|---|---|---|
| DE | 2501012 | A1 | 7/1976 |
| DE | 4317767 | A1 | 12/1994 |

(Continued)

OTHER PUBLICATIONS

SBC; SBC Magazine; 33 pages; Madison, WI; Sep. 2008.

(Continued)

*Primary Examiner* — Matthew Katcoff
(74) *Attorney, Agent, or Firm* — Robert J. Harter; www.bobharter.com

(57) ABSTRACT

A lumber handling method identifies the existence and direction of crowning in dimensional lumber and automatically orients the board and specifies a cutting direction prior to a saw cutting the board into one or more board segments to be used in a structural board assembly, such as in a truss or a wall panel. Crowning is a curve that occurs along a narrow convex edge of a board, wherein the curve is about an axis that is perpendicular to the board's widest face. In some examples, a board's crown is detected by a row of photoelectric sensors. In some examples, the method involves calibrating the sensors by passing a straight board past the sensors. In some examples, the convex and/or concave edges of the board are marked.

20 Claims, 20 Drawing Sheets

(56) References Cited

U.S. PATENT DOCUMENTS

| | | | | |
|---|---|---|---|---|
| 3,894,625 | A | 7/1975 | Boyle et al. | |
| 3,952,883 | A | 4/1976 | Phillips | |
| 4,185,672 | A | 1/1980 | Vit et al. | |
| 4,560,456 | A | 12/1985 | Heil et al. | |
| 4,610,360 | A | 9/1986 | Forslund | |
| 4,640,655 | A | 2/1987 | Jacobsen | |
| 4,838,748 | A | 6/1989 | Johnson | |
| 5,096,090 | A | 3/1992 | Schwartz et al. | |
| 5,249,915 | A | 10/1993 | Ritola | |
| 5,806,868 | A | 9/1998 | Collins | |
| 5,879,129 | A | 3/1999 | Newnes et al. | |
| 5,893,468 | A | 4/1999 | Holmes | |
| 5,899,659 | A | 5/1999 | Beilsmith | |
| 6,065,927 | A | 5/2000 | Baron et al. | |
| 6,178,858 | B1* | 1/2001 | Knerr | B27B 1/007 144/3.1 |
| 6,379,105 | B1 | 4/2002 | Aylsworth | |
| 6,923,614 | B2 | 8/2005 | Aylsworth | |
| 7,736,120 | B2 | 6/2010 | Pierson et al. | |
| 7,746,481 | B2 | 6/2010 | Kranz et al. | |
| 7,950,316 | B2 | 5/2011 | Koskovich | |
| 8,348,287 | B1 | 1/2013 | Smith | |
| 2003/0006586 | A1 | 1/2003 | Comilla | |
| 2006/0207686 | A1* | 9/2006 | Strebig | B27B 1/007 144/356 |
| 2006/0219071 | A1* | 10/2006 | Pobuda | B27B 1/007 83/42 |
| 2009/0255607 | A1* | 10/2009 | Barker | B23D 59/008 144/357 |
| 2012/0227866 | A1* | 9/2012 | Barker | B23Q 17/20 144/357 |
| 2014/0138290 | A1* | 5/2014 | Saastamo | B07C 5/14 209/552 |

FOREIGN PATENT DOCUMENTS

| | | | |
|---|---|---|---|
| DE | 19617818 | A1 | 11/1997 |
| FR | 2673923 | A1 | 9/1992 |
| FR | 2675493 | A1 | 10/1992 |

OTHER PUBLICATIONS

Stiles, Weinmann Robotic Saw System and Material Handling Portal, sales advertisement in SBC magazine; 1 page Madison, WI; published Sep. 2008.

Miser; Automated Wood Processing System; Koskovich brochure; 5 pgs.; Rochester, MN; copyright 2007.

Omni; Automated Lumber Processing System; CAD drawings; 2 pgs.; published 2008 or earlier.

Wood Truss Systems; 2006 Weinmann WBZ 100 Linear Saw; sales advertisement; 2 pgs., equipment itself in publich domain in 2006 or earlier.

Handling Portal WHP; Weinmann sales specs.; one page; published 2008 or earlier.

Stiles; Weinmann Robotic Saw System; sales literature and equipment specs; 6 pages; equipment itself in public domain in 2006 or earlier.

Mereen-Johnson, Rip Navigator Rip Optimizing Systems, video published via YouTube.com on Mar. 10, 2016; www.youtube.com/watch?v=DgMIFPFLm9M.

* cited by examiner

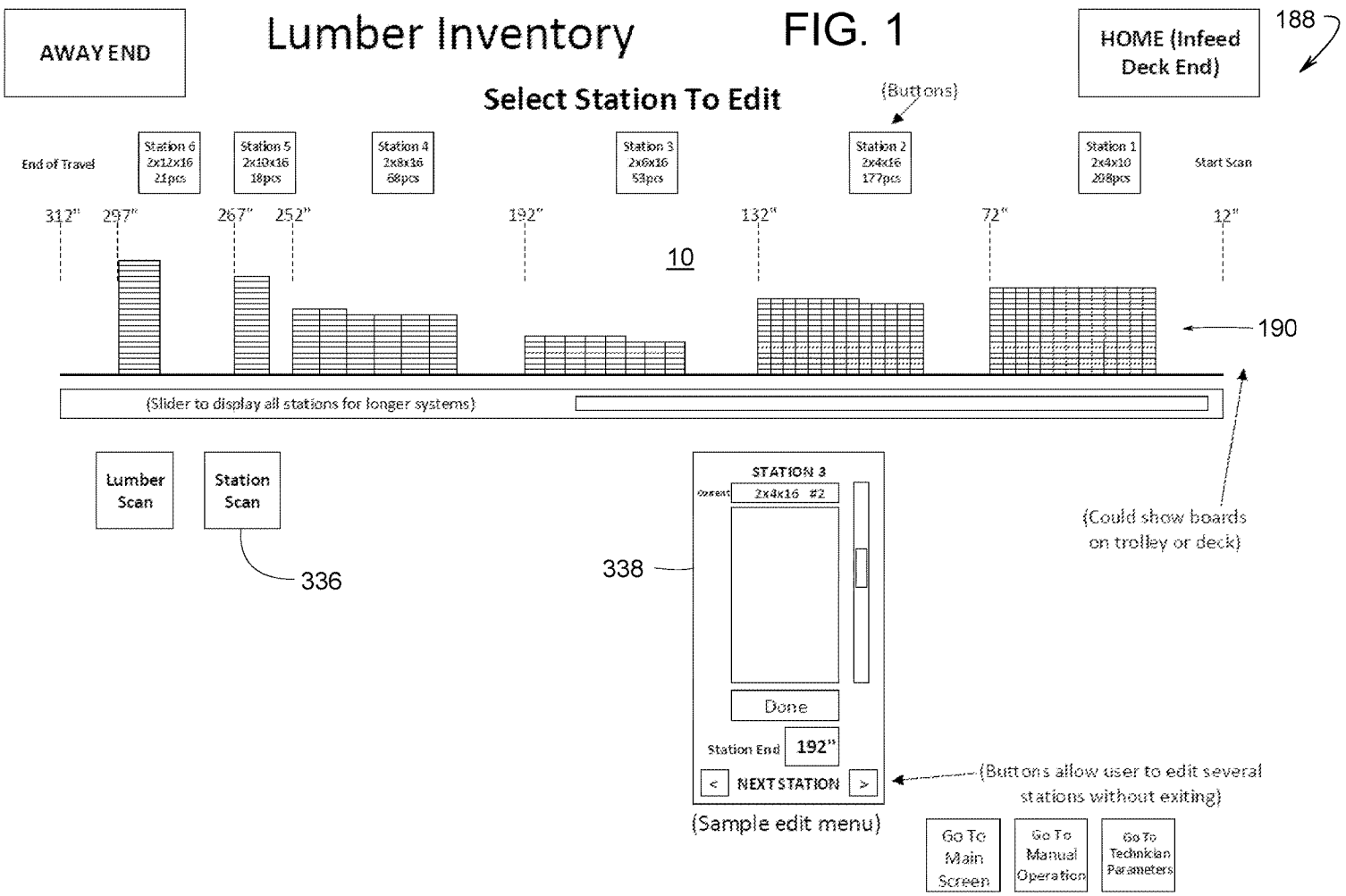
188
HOME (Infeed Deck End)
AWAY END
Lumber Inventory
Select Station To Edit
FIG. 1
{Buttons}
Station 1 2x4x10 208pcs
Station 2 2x4x16 177pcs
Station 3 2x6x16 53pcs
Station 4 2x8x16 68pcs
Station 5 2x12x16 18pcs
Station 6 2x12x16 24pcs
Start Scan
End of Travel
12"
72"
132"
192"
252"
267"
297"
312"
10
190
{Slider to display all stations for longer systems}
{Could show boards on trolley or deck}
Station Scan
Lumber Scan
336
338
STATION 3
2x4x16 #2
Done
Station End
192"
NEXT STATION
{Sample edit menu}
{Buttons allow user to edit several stations without exiting}
Go To Technician Parameters
Go To Manual Operation
Go To Main Screen FIG. 6
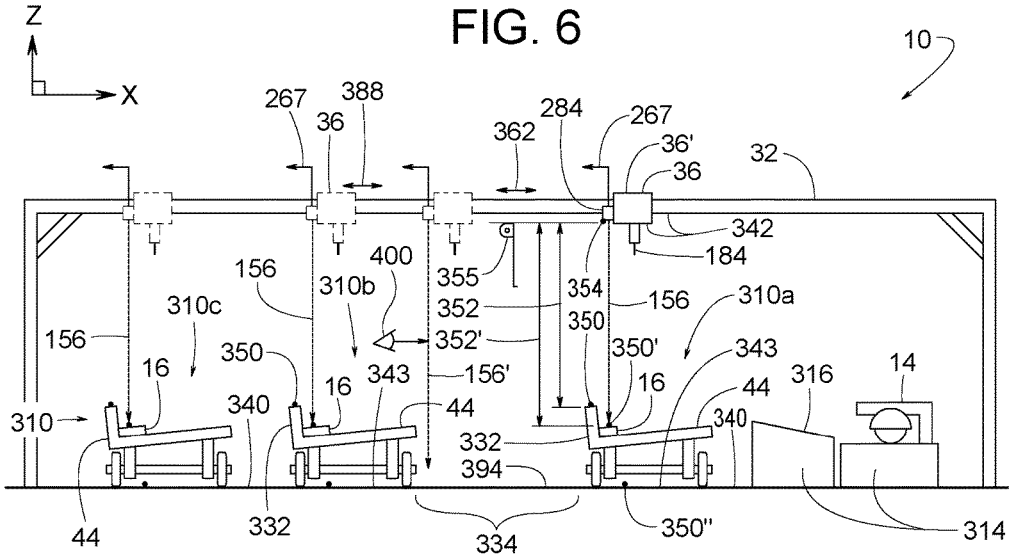
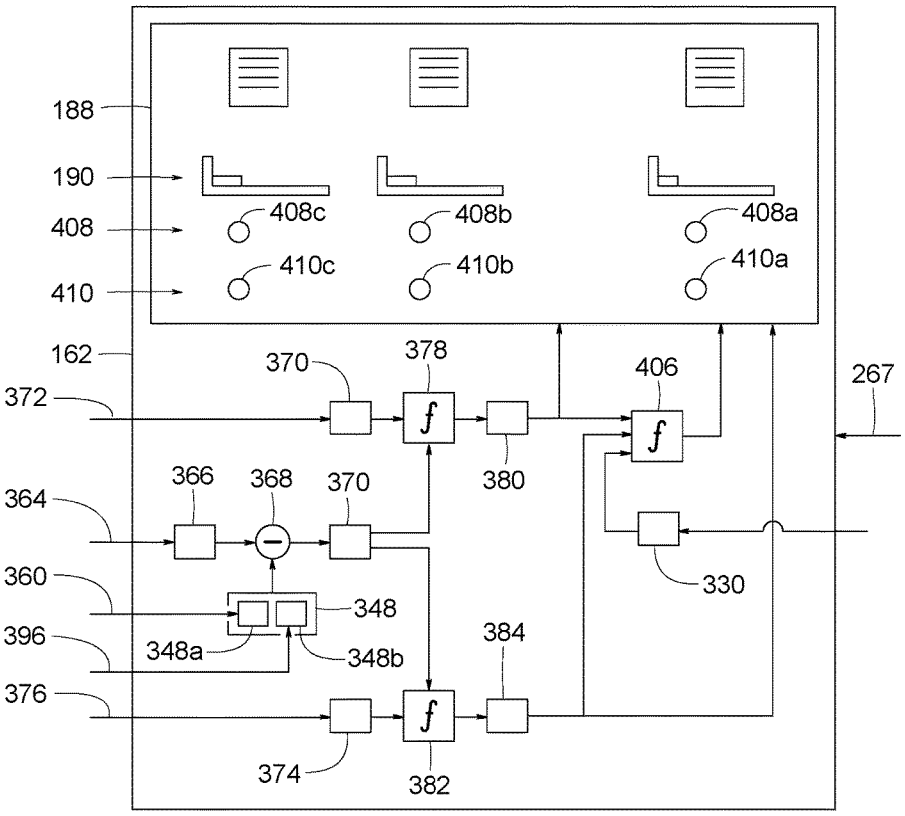

FIG. 7
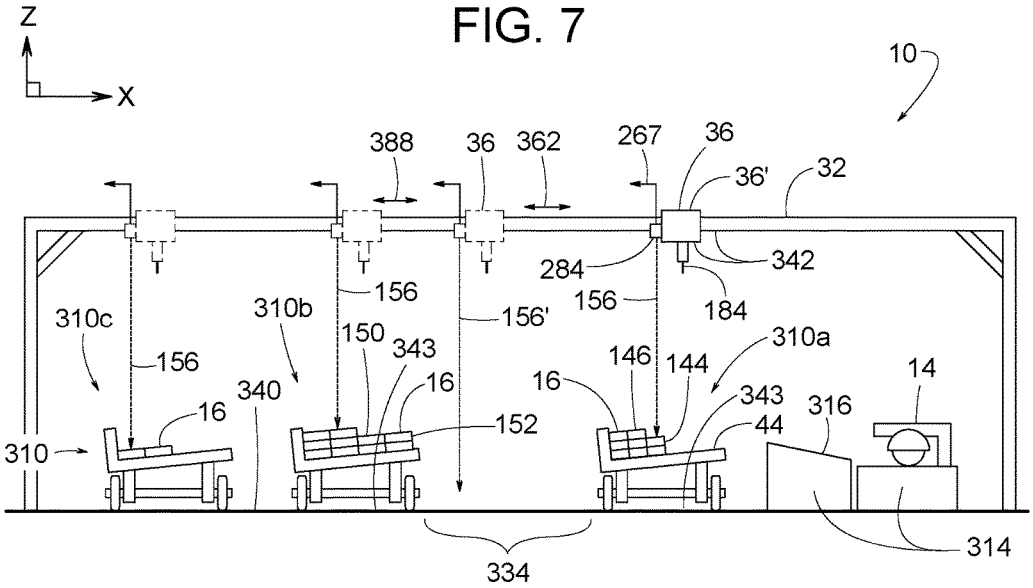
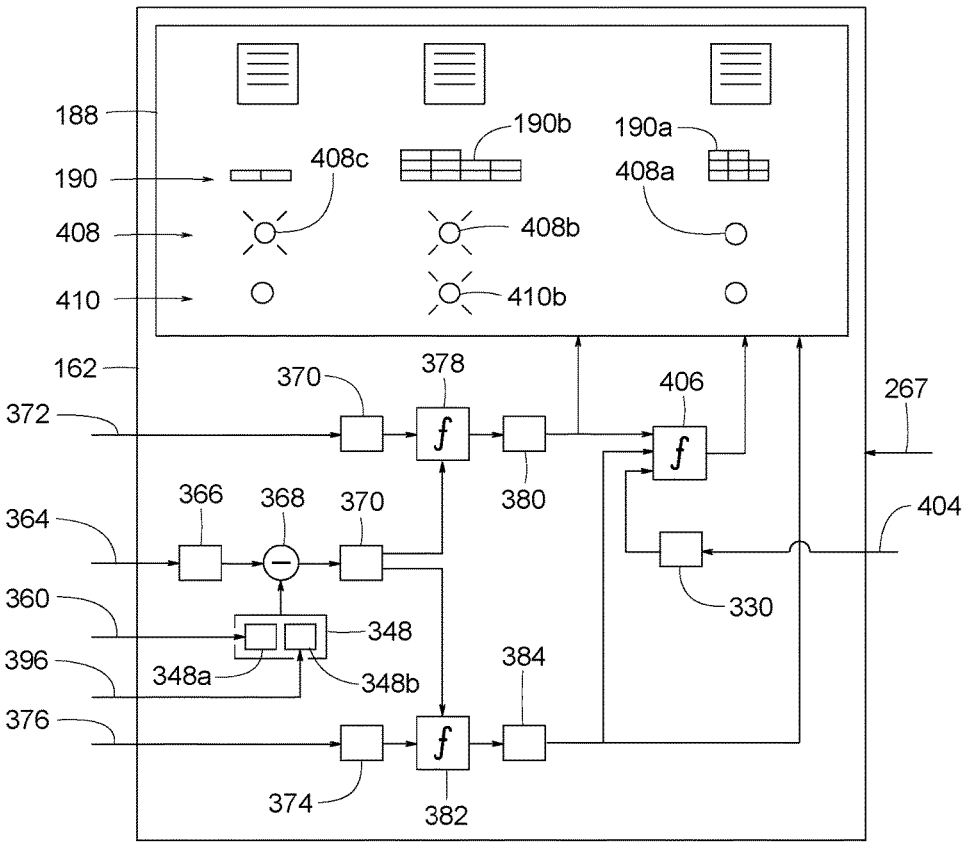

LUMBER RETRIEVAL METHOD WITH SELECTIVE CROWN ORIENTATION

CROSS REFERENCE TO RELATED APPLICATIONS

This present application is a continuation-in-part of U.S. patent application Ser. No. 15/331,824 filed on Oct. 22, 2016; which is a continuation-in-part of U.S. patent application Ser. No. 14/577,779 filed on Dec. 19, 2014; which is a division of U.S. patent application Ser. No. 13/136,922 filed on Aug. 15, 2011 now U.S. Pat. No. 8,960,244; which claims priority to provisional patent application No. 61/402,654 filed on Sep. 2, 2010. This present application also claims priority to provisional patent application No. 62/324,151 filed on Apr. 18, 2016. Each of the aforementioned applications and U.S. Pat. No. 8,960,244 are specifically incorporated herein by reference.

FIELD OF THE DISCLOSURE

This provisional patent application generally pertains to material handling and more specifically to the retrieval and delivery of lumber.

BACKGROUND

Various machines and methods have been developed for retrieving individual pieces of lumber or boards stacked at one location and feeding the boards individually to a saw. Examples of such systems are disclosed in U.S. Pat. Nos. 6,379,105 and 6,923,614; each of which are specifically incorporated herein by reference. Additional lumber handling systems are disclosed in U.S. Pat. Nos. 2,730,144; 3,873,000 and 3,952,883; each of which are specifically incorporated herein by reference. A lumber processing system for making prefabricated trusses and panels is disclosed in U.S. Pat. No. 7,950,316; which is specifically incorporated herein by reference.

In some cases, boards are manually delivered to the saw by a worker. Often the worker will visually inspect a board for warpage before delivering it to the saw. If a curved board has a noticeable crown (i.e., a convexity due to the board being curved about an axis that is perpendicular to the broadest face of the board), sometimes the worker will present the board to the saw with the crown in an orientation that is favorable for use in a truss or wall assembly.

BRIEF DESCRIPTION OF THE DRAWINGS

FIG. 1 is a schematic diagram showing an example system and method for automatically setting up and calibrating lumber stations for an automatic lumber retrieval system in accordance with the teachings disclosed herein.

FIG. 6 is a schematic diagram showing an example system and method for automatically setting up and calibrating lumber stations for an automatic lumber retrieval system in accordance with the teachings disclosed herein.

FIG. 7 is a schematic diagram similar to FIG. 6 showing the example system and method for automatically setting up and calibrating lumber stations, wherein the stations are stocked with lumber.

DETAILED DESCRIPTION

Figure 2:
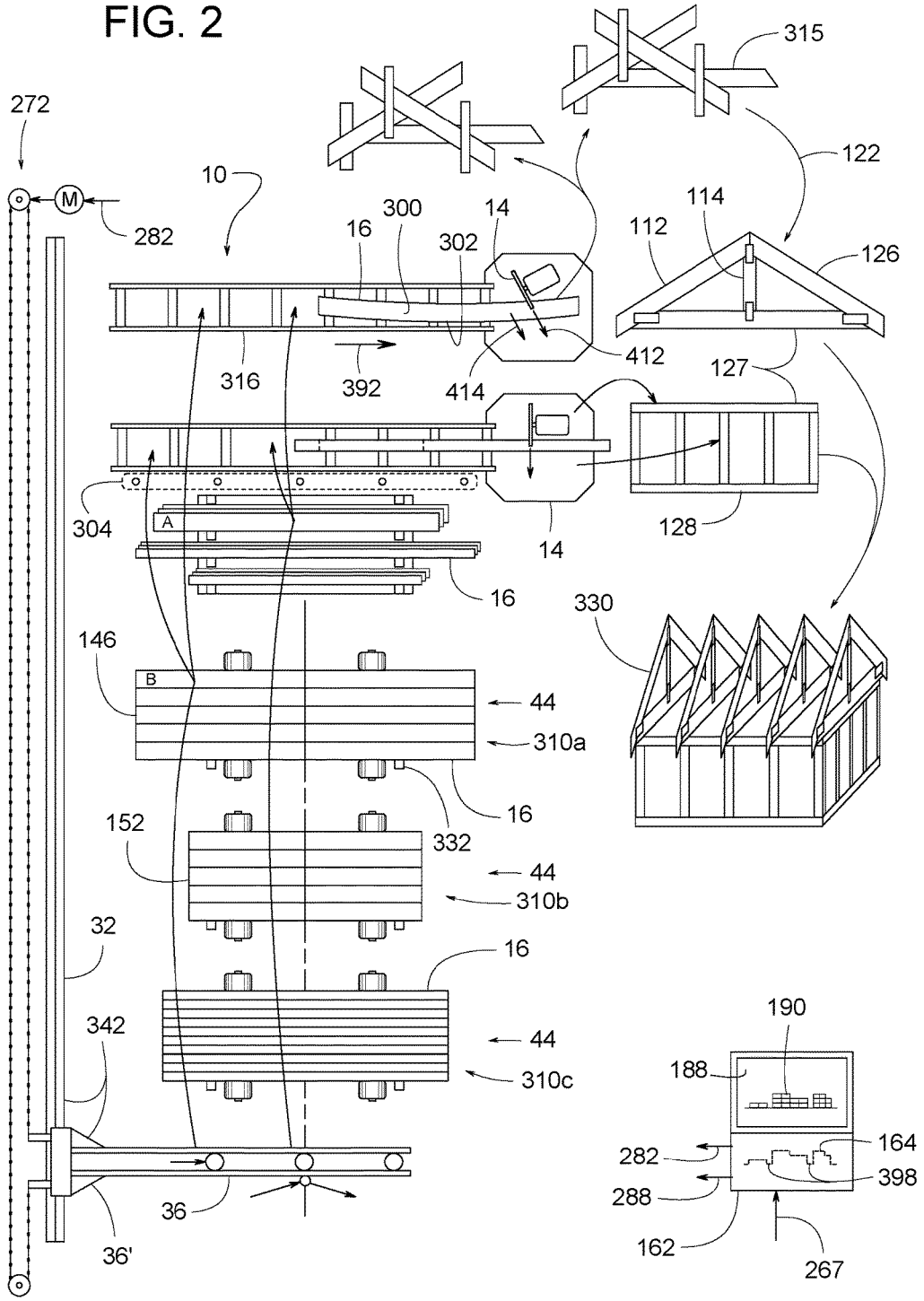
FIG. 2 is a top view similar to FIG. 1 of U.S. Pat. No. 8,960,244.

Floor/Track Compensation, Define Stations and Monitor Inventory (FIG. 1)

FIGS. 1-5 illustrate examples of a lumber retrieval system 10 and related methods that applies to the systems and methods disclosed in U.S. Pat. No. 8,960,244; which is specifically incorporated herein by reference. Items in FIGS. 1-9 having the same or similar reference numbers as those found in U.S. Pat. No. 8,960,244 generally correspond to similar or identical items of that patent.

The illustrated lumber retrieval system 10 enables users to rapidly change lumber station numbers and locations during the course of a day. Another feature covered here is calculating the quantity of boards 16 in each station 310 (e.g., first station 310*a*, second station 310*b*, third station 310*c*, etc.). This information can be used at the start of a job to determine if there is enough lumber in the system to complete a job order 330 (FIGS. 6 and 7) without hand-counting individual boards 16. This information can also be used during a job to alert the operator (user) that a station 310 is getting low on lumber and allows the operator to prepare more lumber for loading.

In some examples, stations 310 are set by jogging trolley 36 until a laser dot or laser beam 156 of laser unit 284 is a half-inch past the end point of a station 310. In some examples, the end point of that station is then defined by a back stop 332 (upright part) of a lumber support 44 (e.g., a cart or rack) or magazine station. The position value at that point is recorded and then manually entered into the corresponding station input box of a controller 162. This is repeated for each station 310 until all stations are calibrated. The process of positioning the laser dot manually by jogging can be time consuming and might require two persons, one to jog trolley 36 and the other to view its position. In such examples, to reconfigure the system, it is necessary to repeat the manual steps and enter the values. In some examples, the lumber supports 44 or stations 310 must have at least a two-inch gap 334 between the end point of one station 310 and the beginning point of the next station 310. In some examples, this is defined in software in controller 162 to differentiate between the start of the next station versus a single station with a small gap between boards.

In addition or alternatively, system 10 accomplishes the aforementioned method automatically via a scanning algorithm used in the board pick up process. In this case, the operator places one or more boards 16 in each desired station 310 with one of the boards 16 against the station's back stop 332, as shown in FIG. 6. The operator pushing a "Station Scan" button 336 on controller 162 (e.g., on the controller's touchscreen 188 sends trolley 36 and its laser unit 284 down the full length of the system, thereby locating and recording the end point of each station 310. When this scan is performed, the lumber in each station 310 must not have any horizontal gaps between boards greater than two inches. In some examples, a valid station location is the end point found when scanning identifies at least a two-inch empty space (no lumber) beyond it. The beginning of any station 310 beyond the currently found station is automatically defined to start two inches beyond the end point of the current station, assuming lumber and an end point is found for the next station.

Once stations 310 are located and defined, a graphical representation (e.g., image 190) of each located station 310 and its overall dimensions are displayed on the operator's control screen 188. In some examples, the end point for each station 310 is also displayed. Stations 310 are sequentially numbered by the software. A cross sectional view (image 190) of the lumber stack is displayed as defined by a height measurement made by laser unit 284 and a horizontal location for each height measurement based on the encoded trolley/laser position along track 32.

At this point, system 10 might not be aware of the size of the individual boards 16 in each station 310 because several boards 16 may be positioned tightly against each other, side-by-side. To set the size, in some examples, the operator selects the graphical representation of an individual station (e.g., via touchscreen 188 or mouse), and a selection box 338 appears with lumber size and description choices. After choosing a size (2×4 for example), the software produces a grid work of rectangles based on the cross sectional size of a 2×4 and overlays the grid onto the displayed view of the lumber stack cross section, thus showing the size and stacked location of individual boards 16. In this manner each station 310 is rapidly defined and set up. Another variation of this would be to place only one board 16 in each station 310 and let the scanning determine and automatically set the lumber size. This might be useful at initial setup of the machine before quantities of lumber are added.

Knowing the height, width, shape and size of the lumber allows easily calculating the quantity of boards 16 in each station 310. One possible problem with calculating the exact height of the lumber stack, however, is that individual stations 310 may vary in elevation because of changes in floor height. The truss, framework or track 32 supporting trolley 36 and laser unit 284 may also bow up or down, which would affect the height measurement of the stack as seen by laser unit 284. In some examples, compensation for this at machine installation and startup is done by "mapping" the height variation over the length of the system.

One way to accomplish this would be to place one board 16 in each available station 310 and scan the entire length to record the heights of boards 16 and their horizontal location within the system. This would define the height error over the length of the system as it was installed, taking into account any height variation of floor 340 and track 32. The resulting "map" is then used to automatically adjust the height readings of lumber stacks in stations 310, thus allowing the system to correctly calculate the number of boards 16 in each station 310. Another way to map the system height is to physically measure the height of laser unit 284 to floor 340 (e.g., with a tape measure) at various horizontal locations and input the measured values into software of controller 162 to create a calibration map.

In some examples, a lumber handling method for retrieving a plurality of boards of various sizes from a plurality of stations supported by a floor is defined as comprising: a trolley carrying a laser scanner over the plurality of stations; the laser scanner scanning the plurality of boards; identifying discrete stations of the plurality of stations based on scanning at least a predetermined gap size between two adjacent stations of the plurality of stations; calculating a floor compensation for a potential variation in floor height of the floor; calculating a trolley compensation for a potential error in a linearity of a travel path of the trolley; calculating a number of boards in a chosen station of the plurality of stations based on a size of a board at the chosen station, a laser-scanned map of the chosen station, the floor compensation and/or the trolley compensation; and providing a notification of when the number of boards in the chosen station decreases to a predetermined lower limit.

Trolley Speed Function of Board Weight/Length (FIG. 2)

A lumber delivery machine might present hazards to personnel working nearby and are generally protected with a "light curtain" safety device which senses a person entering a dangerous area of the machine's operating space. The danger might involve being struck by traveling machine parts or the board which is being transported by machine 10. The light curtain consists of one or more light beams from an emitter that are monitored continuously by a receiver. Light curtains are well known and commonly used for safety protection. A worker entering the protected zone will break one of the beams and initiate a rapid stop of the machine. This is typically done by disconnecting power to the drive motors and applying a brake to rapidly stop the machine when personnel are detected. The light curtain safety device is located beyond the dangerous area and set back an additional distance to allow the machine to come to a complete stop before the personnel can reach the hazardous movement. The amount of setback is determined by using a safety formula which is accepted by the applicable safety agency or authority having safety jurisdiction. The approach speed of a person and the stopping time of the machine are used in the equation to compute setback requirements. Higher machine speeds increase the stopping time of the machine and accordingly require a larger setback of the light curtain. Larger setbacks, while desirable for safety reasons, usually use valuable plant space and are therefore regarded as unproductive. The tradeoffs between safety light curtain setback (unproductive space) and machine speed (more productivity) are reduced with the present invention.

Lumber retrieval machine 10 includes trolley 36 and is set up to deliver different sizes of boards 16 from a plurality of stations 310 to a saw 14 or other secondary process. Boards 16 can vary in length from as short as 5 ft to as long as 24 ft. Safety light curtains are setback from the hazard, which may be the end of a 24-ft board or may be the moving trolley 36 of machine 10, depending on whether a board 16 is being retrieved or whether trolley 36 is returning for another board and is not carrying a board. It can be seen from this explanation that the distance to the safety hazard varies depending on the length of a board being carried and whether a board 16 is even present. This fact allows the trolley travel speed (and hence the stopping distance) to also be variable based on the presence or absence of a board and the board's length. In some examples, a suitable board length detection system accomplishes this. The detection system could take many forms. One method, for example, would be based on sensors to measure the boards (length, width, thickness, and/or weight) and another would require board measurement input (length, width, thickness, and/or weight) from the sawing process being fed by lumber delivery system 10. Using this information, the maximum speed is easily calculated and implemented by the processor controlling trolley 36 and lumber delivery system 10. This allows trolley 36 to travel faster when unloaded or when carrying a shorter or lighter board.

In some examples, the invention is defined as a lumber handling method of using a trolley 36 for retrieving a board 16 from a plurality of boards of various sizes from a plurality of stations 310 and transferring board 16 toward saw 14, wherein the lumber handling method comprises: the trolley traveling over at least one station of the plurality of stations while the trolley is carrying the board; the trolley traveling over the at least one station while the trolley is not carrying the board; and limiting a travel speed of the trolley based on at least one of the following: (a) a weight of the board, (b) a length of the board, and (c) whether or not the trolley is carrying the board.

In some examples, a lumber handling method of using a trolley for retrieving a board from a plurality of boards of various sizes from a plurality of stations and transferring the board toward a saw is defined as comprising: the trolley traveling over at least one station of the plurality of stations while the trolley is carrying the board; the trolley traveling over the at least one station while the trolley is not carrying the board, and limiting a travel speed of the trolley based on at least one of a weight of the board and a length of the board.

Figure 3:
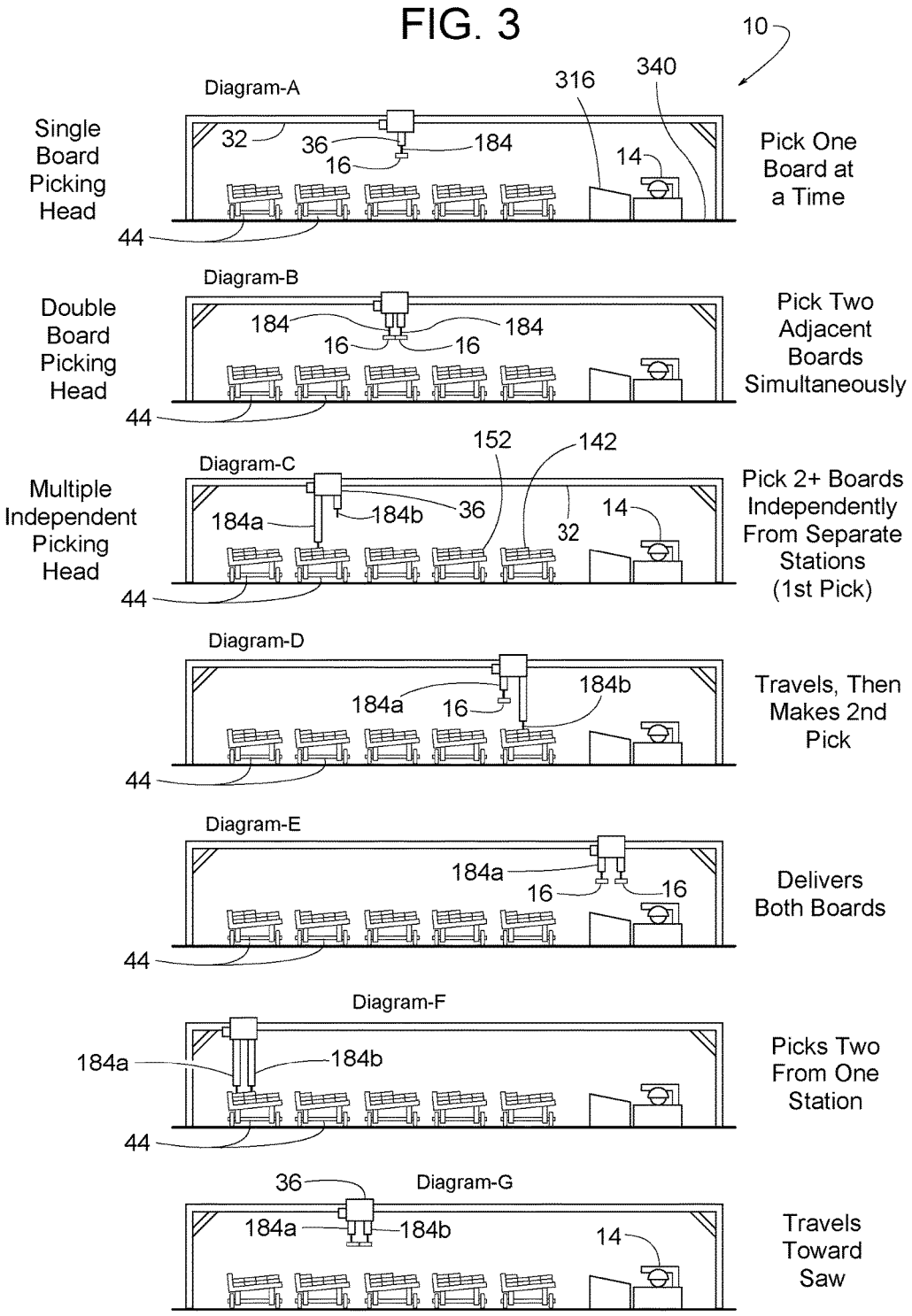
FIG. 3 is a series of diagrams showing a side view of various example systems and methods for automatic lumber retrieval systems in accordance with the teachings disclosed herein.
Figure 4:
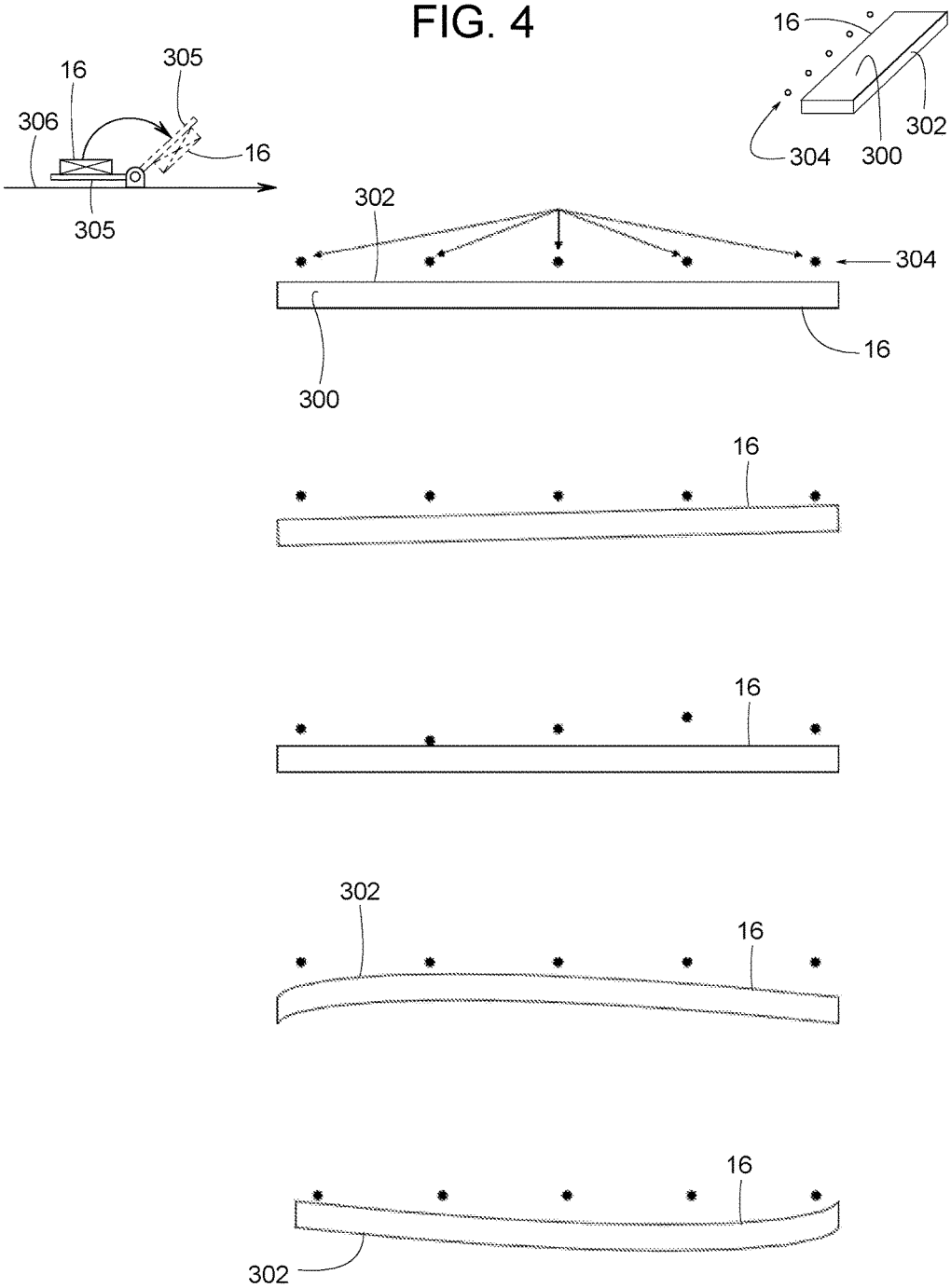
FIG. 4 is an assortment of views showing various example systems and methods for automatic lumber retrieval systems in accordance with the teachings disclosed herein.

Independent Dual Head (FIG. 3)

Some examples of lumber retrieval system 10 include a single set of board pickers 184 (for picking up one board 16), as shown in Diagram-A of FIG. 3. Other examples include two sets of board pickers 184 (for picking up two boards 16 of equal or different size), as shown in Diagram-B of FIG. 3. Board picker 184 is schematically illustrated to represent any apparatus capable of lifting board 16 up from a lumber support or stack of lumber. Examples of board picker 184 include, but are not limited to, piercing tools, suction cups, hooks, grippers, etc. The single head version can retrieve a single board 16 in one cycle and deliver it to saw 14 or other process. The double board picking head version can pick up two boards 16 at once and deliver them in a single cycle. In some examples, both use a single vertical pickup axis. Some double board versions are equipped with multiple pick up devices (board picker) on a single head making it capable of lifting two boards simultaneously and delivering them to the process. This speeds the delivery of lumber when compared to the single board version especially in the case of a large system where travel time increases due to the length of travel required.

The single head version has delivery speed limitations based on delivering only one board per cycle. Some two board versions can improve on the delivery speed, but only under certain circumstances. In some versions, two boards being picked up must lie adjacent to each other. In some examples, the pickup devices for each board are a fixed distance apart making it unsuitable for two boards that are not spaced to match the fixed distance. This limits its use to certain sizes of boards. In such examples, any two boards must be picked up simultaneously which means they must come from the same lumber stack. Because boards in stacks are often skewed it is not possible or desirable to pick up a board on one stack and then lower the first picked board again to pick up from a second stack, as the board being lowered may interfere with the second lumber stack. Requiring the two boards to come from the same stack and hence be the same dimensions is a limitation of such systems. Some end processes, such as sawing, may require different sized boards in the cutting sequence making it undesirable to deliver two like-sized boards at once. A further disadvantage lies in the fact that the double board head must retrieve adjacent boards. Sometimes adjacent boards are not available, as when there is a single board left on a layer.

The new multiple picking head design, as shown in Diagrams C-G does not have these shortcomings. The construction uses two individual picking heads 184*a* and 184*b*, each with its own vertical axis which can be operated independently. They are mounted to a single trolley 36 and move together in the horizontal direction. The spacing on the two heads 184*a* and 184*b* is wide enough to pick up two wide boards (2"×12" for example) without interference from each other. Boards 16 can easily be picked up from the same stack of lumber (e.g., from a first stack of lumber 146) if like sized boards are required or picked up from two different lumber stacks 146 and 152 to deliver different sized boards. The end process, such as sawing, can now receive unlike boards 16 in sequence and delivered in one cycle. Diagram-C shows head 184*a* picking a first board 16 from one stack, Diagram-D shows head 184*b* picking a second board 16 from another stack, Diagram-E shows both boards 16 being delivered to saw 14, Diagram-F shows heads 184*a* and 184*b* retrieving a second pair of boards 16, but this time the two boards 16 are identical and taken from the same stack, and Diagram-G shows trolley 36 delivering both boards 16 to saw 14.

A further advantage of the design shown in Diagrams C-G is that if one picking head 184*a* or 184*b* malfunctions, the other head can still be used in a single board per cycle delivery mode to keep the end process supplied with lumber. This design shown in Diagrams C-G is not limited to double picking head design, as any number of picking heads 184 could be added to a single trolley 36 to increase production by delivering multiple boards 16 per cycle. This design would be especially advantageous when feeding multiple saws 14 or processes with one lumber retrieval system.

In some examples, a lumber handling method of using a trolley for transferring a load toward a saw, wherein the load comprises selectively a first board, a second board, and a combination of both the first board and the second board, the lumber handling method is defined as follows: in a first selected operation, the trolley carrying the first board without the second board toward the saw; in a second selected operation, the trolley carrying the second board without the first board toward the saw; and in a third selected operation, the trolley carrying simultaneously the first board and the second board toward the saw.

Selective Crown Orientation (FIGS. 4 and 10-37)

This is a description of a lumber handling method 420 for identifying the existence and direction of crowning in dimensional lumber and orient it correctly before sawing. Crown is a warp or curve that occurs along a narrow convex edge 302 of a board 16 (i.e., curve about an axis that is perpendicular to the widest face 300 of board 16). When lumber is used for the construction of roof trusses 126 or wall panels 128 it might be advantageous to identify the crown direction and orient the crown correctly before cutting board 16 into a smaller board segment 16*a*. In roof trusses, for example, it might be advantageous to assemble the truss with the convex crowned edge 302 facing upward in the truss. With the present invention, the non-symmetrical angles of the roof truss components are cut after the crown is detected and the lumber is oriented accordingly. This invention detects the crown direction and automatically orients board 16 correctly based on the requirements of the sawing operation. The crown can be introduced to saw 14 either convex or concave side first, depending on the job requirements.

Figure 10:
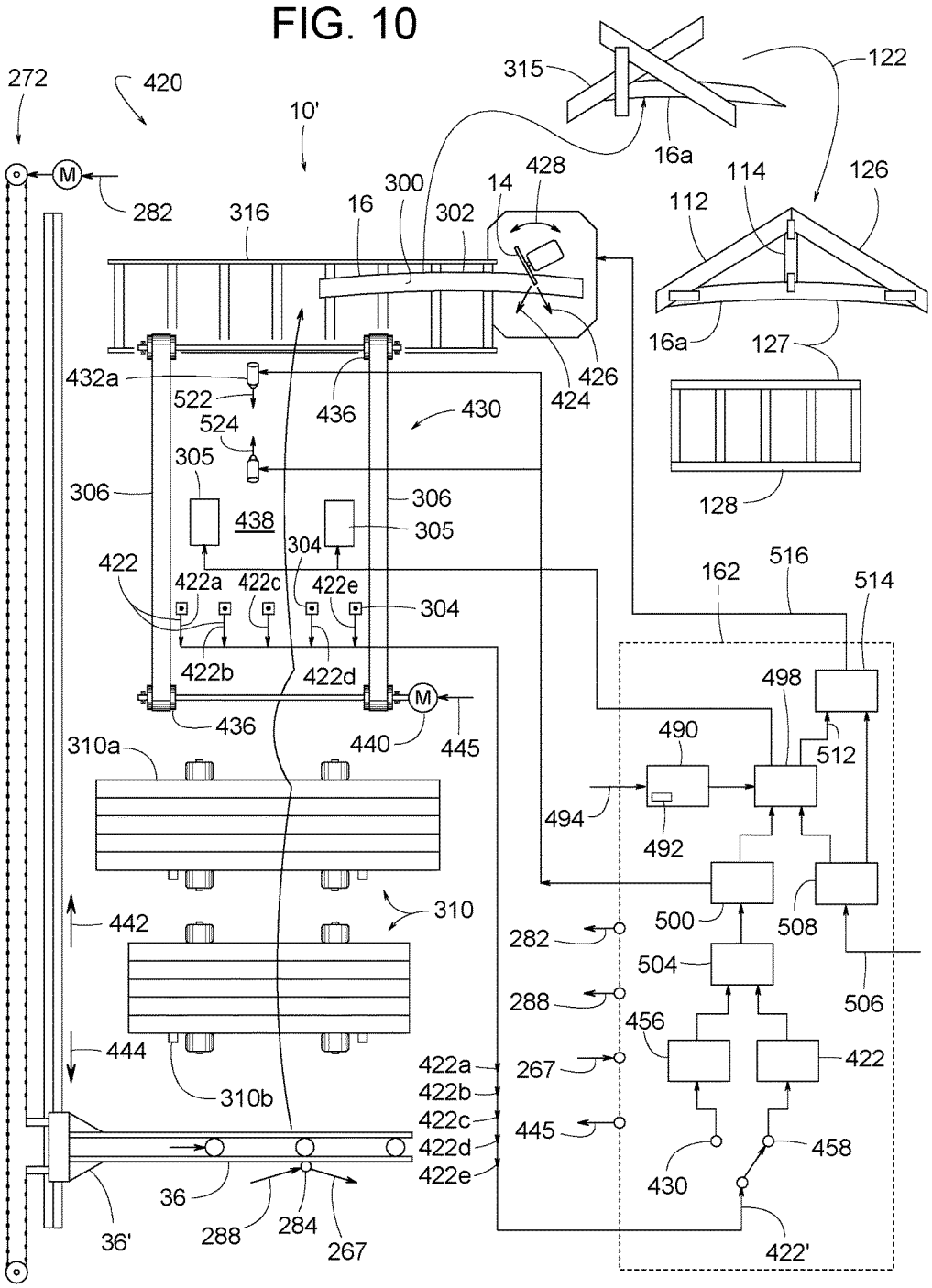
FIG. 10 is a schematic top view similar to FIG. 2 but showing another example of a lumber retrieval system and lumber handling method in accordance with the teachings disclosed herein.
Figure 11:
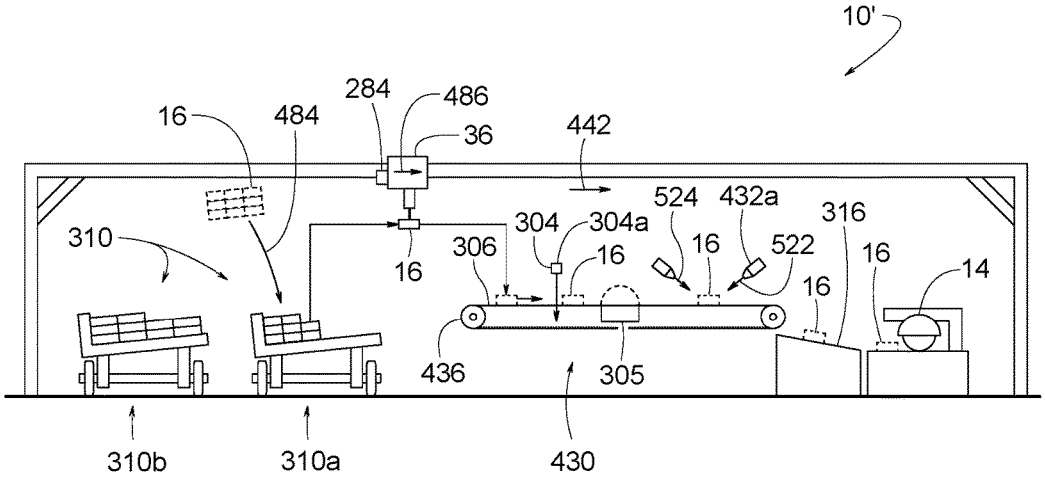
FIG. 11 is a schematic diagram similar to FIG. 6 but showing another view of the lumber retrieval system of FIG. 10.
Figure 12:
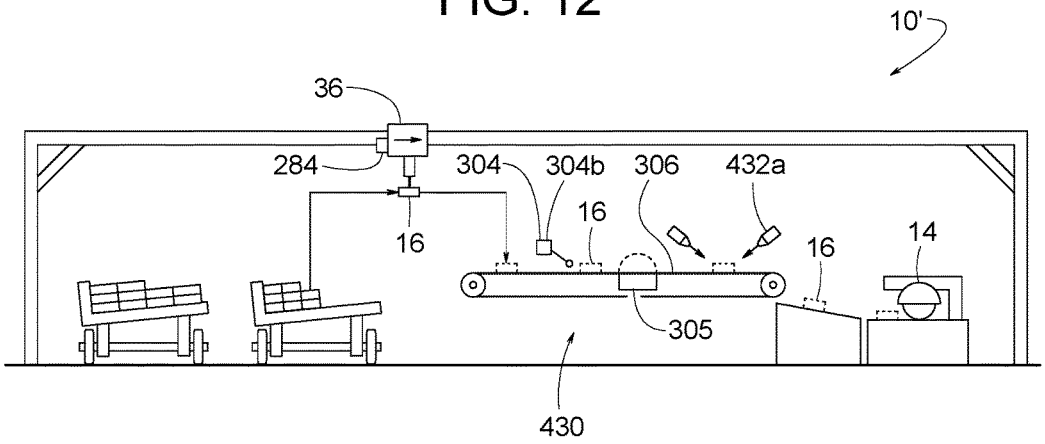
FIG. 12 is a schematic diagram similar to FIG. 11 but showing another example of a board sensor system constructed in accordance with the teachings disclosed herein.

This crown responsive method can be incorporated into lumber retrieval system 10 (e.g., see system 10' in FIGS. 10, 11 and 12). Boards 16 are conveyed laterally on a series of conveyor chains or belts (schematically identified as board transfer means 306). The longest length of board 16 is roughly perpendicular to the generally horizontal travel direction of the conveyor or trolley that moves board 16. In some examples, a series of sensors 304 (e.g., photoelectric sensor 304*a*, electromechanical switch 304*b*) are triggered when the leading or trailing edges (e.g., edge 302) of board 16 passes over or under them. In some examples, sensors 304 are spaced apart about twelve inches (more or less depending on the accuracy required) and oriented along the length of a board in a generally straight line. Controller 162 (e.g., a PLC, computer, etc.) captures the photoelectric signal 432 from each sensor 304 (plurality of edge readings 422*a-e*) and records the time of each signal as board 16 passes under or over sensors 304. Software evaluates the timing of signal 432 and plots the times as a line. The deviation from a straight line is calculated mathematically to determine the amount and direction of crown. Note that the board may be skewed on the conveyor and a perfectly straight board would actuate each sensor sequentially from one end to the other. This does not adversely affect the calculation of the deviation from a straight line when crowned boards are scanned, nor does it adversely affect the calculation for a straight board with no crown.

After the crown has been detected, a board turning device 305 (e.g., board flipper devices 305*a*, 305*b*, 305*c*, 305*d*) may be used to reorient the board to the preferred crown direction (if required) to prepare it for sawing. Some examples of system 10' do not require board turning device 305 to orient the board but instead alter the cutting direction of saw 14, as indicated by arrows 424, 426 and 428 of FIG. 10 and arrows 426 and 424 of FIG. 13. Sending the crown direction to certain saws may cause the saw to re-orient the cuts in the components to match the identified crown, therefore producing parts with the desired crowning direction.

In some examples, a feature incorporated into the software of controller 162 is a self-learning calibration mode. It can be difficult to orient all the sensors 304 in a perfectly straight line and keep them straight. Because of this, a simple way to compensate for this has been devised. To calibrate, the operator puts controller 162 into a calibration mode 430 and sends a perfectly straight board 16 through the system. Even though sensors 304 might not be in a straight line, controller 162 can detect the curve generated by the straight board and the non-linear sensors and quickly compensate by computing a "map" or correction value for each sensor 304. This will then be applied to all subsequent calculations to correct for the non-aligned sensors 304 until the system is calibrated again.

In some examples, a lumber handling method of using a trolley for transferring a board from a station toward a saw, wherein the board is warped in either a first direction or a second direction, the lumber handling method is defined as comprising: determining in which direction the board is warped; the trolley transferring the board between the station and the saw; the saw cutting the board; and based on which direction the board is warped, selectively inverting (turn board's upper face down) or not inverting (leave board's upper face facing up) the board prior to the saw cutting the board.

Referring to FIGS. 10-12, system 10' comprises a plurality of boards 16 stocked at a plurality of stations 30 (e.g., first station 310*a* and second station 310*b*), saw 14, board-receiving area 316 for feeding boards to saw 14, a transfer station 430 for passing boards 16 onto board-receiving area 316, trolley 36 for delivering chosen boards 16 from at least one station 310 to transfer station 430, and controller 162 responsive to photoelectric laser sensor 284 for controlling the operation of trolley 36, transfer station 430, and/or saw 14. In the schematically illustrated example, transfer station 430 comprises a board-flipper 305, a curved board detector (e.g., sensors 304), an optional board marker 432*a*, and a board transfer means 306.

Board-flipper 305 is schematically illustrated to represent any device that can turn a curved board 16 around such that a crowned edge 302 of board 16 faces in an opposite direction. Some examples of board-flipper 305 include, but are not limited to, board-flipper 305*a* (FIGS. 20-24), board-flipper 305*b* (FIGS. 25-31), board-flipper 305*c* (FIGS. 32-37), and board flipper 305*d* (FIGS. 38-43).

Curved board detector 304 is schematically illustrated to represent any means for determining whether board 16 is curved. Some examples of curved board detector 16 include, but are not limited to, a plurality of sensors such as, for example, a plurality of photoelectric eyes 304*a* (e.g., plurality of laser emitting devices), a plurality of electromechanical switches 304*b* (e.g., a plurality of swing arm limit switches), and a camera with photo/video analytics.

Optional board marker 432*a* is schematically illustrated to represent any apparatus for applying a visual mark 434*a* on board 16. Some examples of board marker 432*a* include, but are not limited to, a paint sprayer, ink applicator, a scratching device, a stamping device, etc.

Board transfer means 306 is schematically illustrated to represent any means for receiving boards 16 from trolley 36 and delivering those boards to board-receiving area 316. Some examples of board transfer means 306 include, but are not limited to, a set of conveyor belts supported by rollers 436 (e.g., sheave, drum, sprocket, etc.), and a set of roller chains supported by rollers 436. In some examples, an open area 438 between the set of conveyor belts or roller chains accommodates the operation of curved board detector 304, board-flipper 305 and/or board marker 432*a*. In the illustrated example, board transfer means 430 is powered by a motor 440 controlled by controller 162 via a signal 445.

One example sequence of operation of system 10' begins with trolley 36 transferring a board 16 from first station 310*a* to board transfer means 306. Board transfer means 306 conveys board 16 across sensors 304. Sensors 304 in conjunction with controller 162 determine whether board 16 is substantially straight, whether board 16 has a positive board curvature and thus curves in a forward direction 442 (crown 302 facing toward board-receiving area 316), whether board 16 has a negative board curvature and thus curves in a rearward direction 444 (crown 302 facing away from board-receiving area 316), and whether board curvature even matters in the board's intended location of use in a structural board assembly 127.

If board 16 is substantially straight, board transfer means 306 transfers board 16 directly to board-receiving area 316, while board-flipper 305 and board marker 432*a* are left inactive. The straight board 16 transfers from board-receiving area 316 to saw 14, which cuts board 16 into one or more board segments 16*a* that are assembled into structural board assembly 127 (e.g., truss 126, wall panel 128, etc.).

If board 16 curves in a positive direction (crown pointed toward board-receiving area 316) and such curvature is desirable or irrelevant for a particular board segment and structural board assembly, then board transfer means 306 transfers board 16 directly to board-receiving area 316, while board flipper 305 is left inactive. Depending on user preference, board marker 432*a* may or may not be activated to mark the board's convex and/or concave edges. The curved board 16 transfers from board-receiving area 316 to saw 14, which cuts board 16 into one or more board segments 16*a*.

Figure 13:
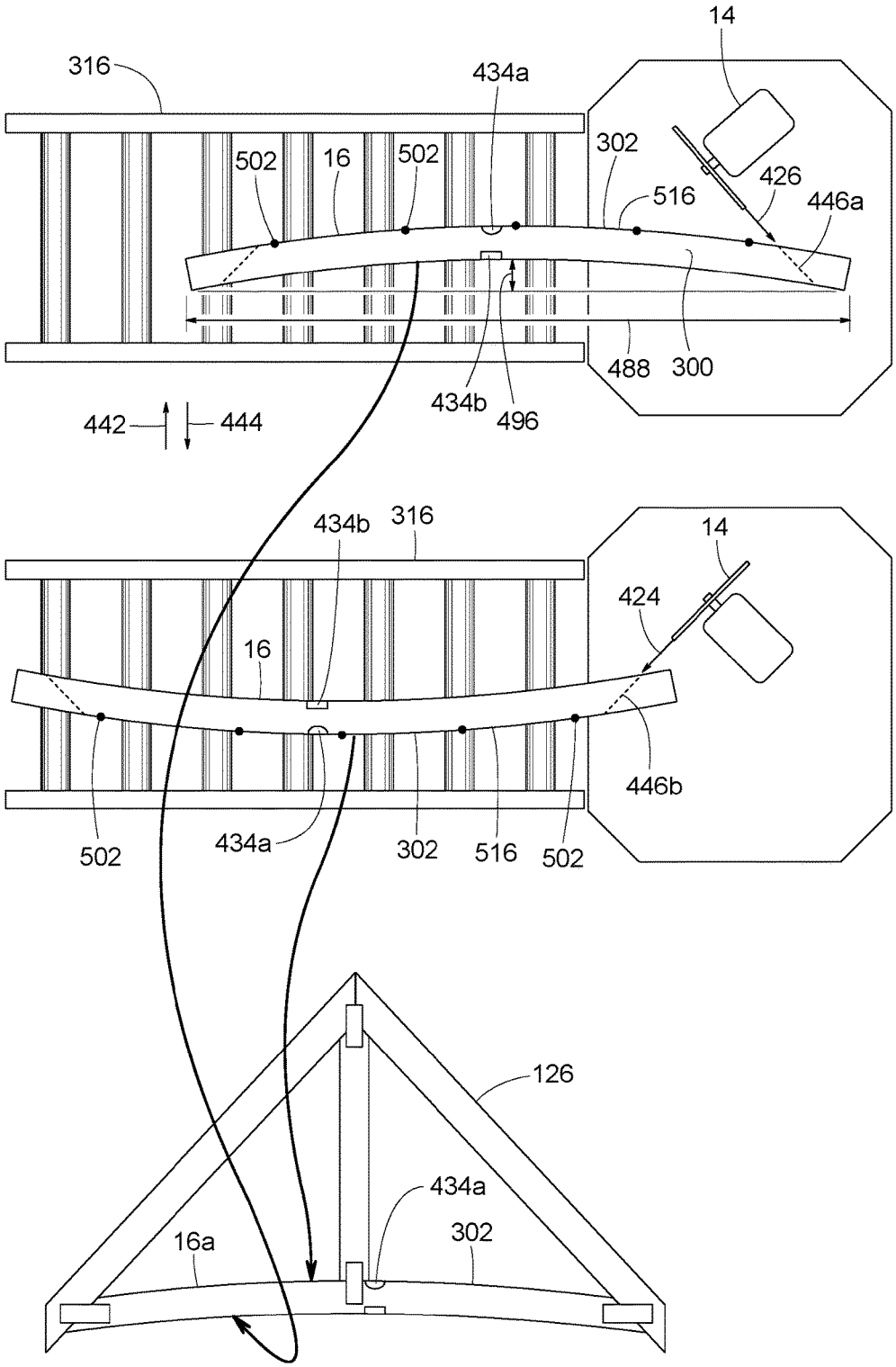
FIG. 13 is a schematic diagram illustrating two alternate example methods of processing a board having a curvature that exceeds a predetermined positive limit of curvature, wherein the methods are in accordance with the teachings disclosed herein.

If board 16 curves in a positive direction but such curvature is undesirable for a particular board segment and structural board assembly, then, in some examples, board flipper 305 turns board 16 from being right-side-up to up-side-down, which points the crowned edge 302 away from board receiving area 316. Alternatively, board flipper 305 is omitted or left inactive while saw 14 is redirected to cut board segment 16*a* at a different, mirror image angle, e.g., cut 446*a* versus cut 446*b*, as shown in FIG. 13. In some examples, board marker 432*a* marks the board's convex and/or concave edges.

If board 16 curves in a negative direction (crown pointing away from board-receiving area 316) and such curvature is desirable or irrelevant for a particular board segment and structural board assembly, then transfer station 430 transfers board 16 directly to board-receiving area 316, while board flipper 305 is left inactive. Depending on user preference, board marker 432*a* may or may not be activated to mark the board's convex and/or concave edges. The curved board 16 transfers from board-receiving area 316 to saw 14, which cuts board 16 into one or more board segments.

If board 16 curves in a negative direction (crown 302 points in rearward direction 444) but such curvature is undesirable for a particular board segment and structural board assembly, then, in some examples, board flipper 305 turns board 16 from being right-side-up to up-side-down, which thus points the crowned edge 302 toward board receiving area 316. Alternatively, board flipper 305 is omitted or left inactive while saw 14 is redirected to cut the board segment at a different, mirror image angle, e.g., cut 446*a* versus cut 446*b*, as shown in FIG. 13. In some examples, board marker 432*a* marks the board's convex and/or concave edges.

FIGS. 14-18 show examples of how sensors 304 detect the straightness or curvature of board 16. In the illustrated example, sensors 304 are installed along a substantially straight line 448. In this example, each sensor 304 is a photoelectric eye of the type having an integral laser emitter.

Figure 14:
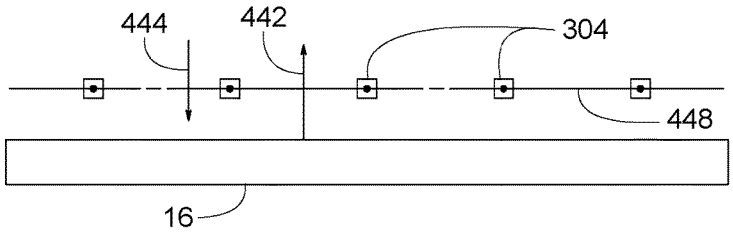
FIG. 14 is a top schematic diagram showing an example series of linearly distributed sensors in the process of sensing a straight board that is parallel to the line of sensors.

When board 16 is straight and parallel to line 448 as board 16 travels past sensors 304, as shown in FIG. 14, the board's leading edge (or alternative trailing edge) simultaneous triggering sensors 304 generates a plurality of edge readings 422. Based on edge readings 422 occurring simultaneously and sensors 304 being in collinear alignment, controller 162 logically concludes that board 16 is substantially straight.

Figure 15:
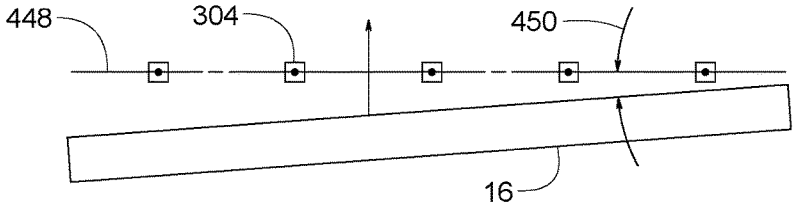
FIG. 15 is a top schematic diagram similar to FIG. 14 but showing the straight board displaced out of parallel alignment with the line of sensors.

When board 16 is straight but lies at a positive angle 450 to line 448 as board 16 travels at a steady speed past sensors 304, as shown in FIG. 15, the board's leading edge (or alternative trailing edge) sequentially triggers sensors 304 in a uniform sequence from right to left. Based on this uniformity of trigger timing and sensors 304 being in collinear alignment, controller 162 logically concludes that board 16 is substantially straight but at the irrelevant positive angle 450.

Figure 16:
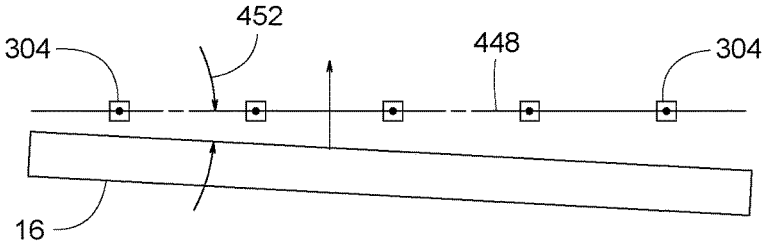
FIG. 16 is a top schematic diagram similar to FIG. 15 but showing the straight board displaced at a different angle relative to the line of sensors.

When board 16 is straight but lies at a negative angle 452 to line 448 as board 16 travels at a steady speed past sensors 304, as shown in FIG. 16, the board's leading edge (or alternative trailing edge) sequentially triggers sensors 304 in a uniform sequence from left to right. Based on this uniformity of timing and sensors 304 being in collinear alignment, controller 162 logically concludes that board 16 is substantially straight but at the irrelevant negative angle 452.

Figure 17:
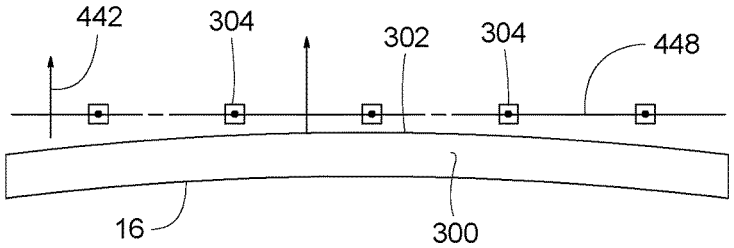
FIG. 17 is a top schematic diagram similar to FIG. 14 but showing the board with a positive curvature.

If board 16 has a positive board curvature with crown 302 facing toward board-receiving area 316, as shown in FIG. 17, the positively curved board 16 will trigger the more central sensors 304 before the outer ones. Based on that, controller 162 logically concludes that board 16 has a positive board curvature.

Figure 18:
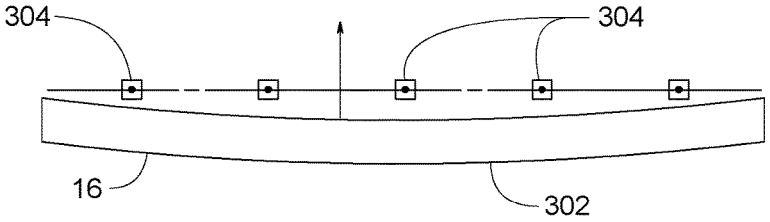
FIG. 18 is a top schematic diagram similar to FIG. 19 but showing the board with a negative curvature.

Conversely, if board 16 has a negative board curvature with crown 302 facing away from board-receiving area 316, as shown in FIG. 18, the negatively curved board 16 will trigger the outer sensors 304 before the more central ones. Based on that, controller 162 logically concludes that board 16 has a negative board curvature.

Figure 19:
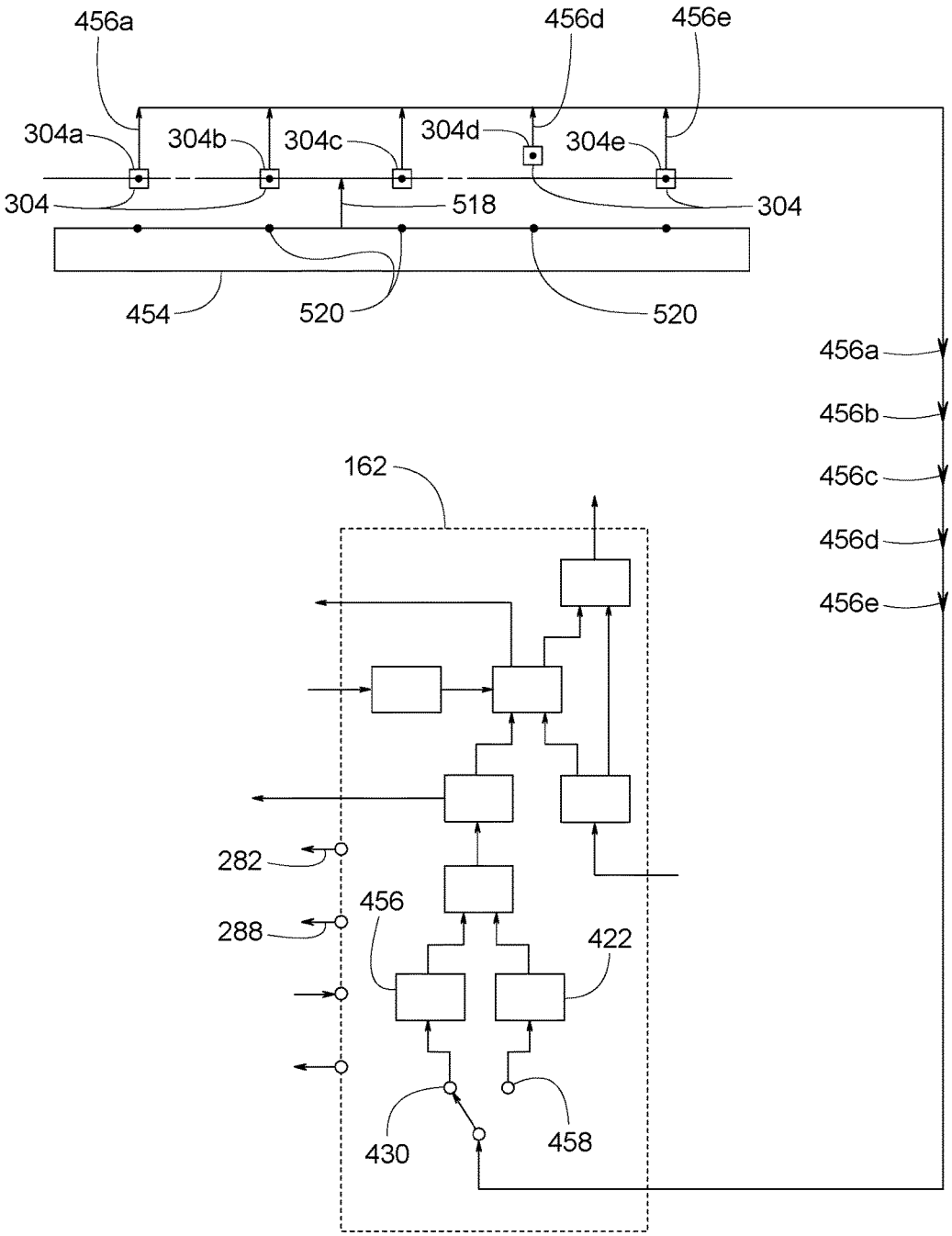
FIG. 19 is a schematic diagram illustrating an example method for calibrating a series of sensors in accordance with the teachings disclosed herein.
Figure 20:
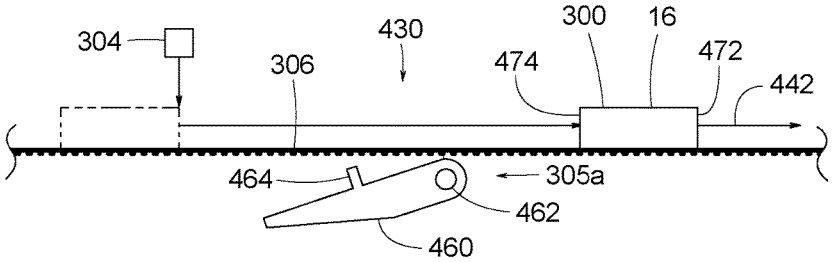
FIG. 20 is a schematic diagram of an example board flipper constructed in accordance with the teachings disclosed herein.

To avoid linearly misaligned sensors 304 from mistakenly identifying a false straight or false curved board, sensors 304 can be calibrated by the example calibration method shown in FIG. 19. In the illustrated example, sensor 304*d* is displaced out of collinear alignment with sensors 304*a*, 304*b*, 304*c* and 304*e*. To calibrate, a standard elongate member 454 is passed by sensors 304. The term, "standard elongate member" refers to any object having a certain shape and having a length extending over the spanned distribution of sensors 304. Examples of standard elongate member 454 include, but are not limited to, a substantially straight board, a substantially straight metal bar, and a curved board or bar. When standard elongate member 454, in the form of a straight board, is read by sensors 304 during calibration, there will be a slight time delay between the edge test reading 456*d* of sensor 304*d* and test readings 456*a*, 456*b*, 456*c* and 456*e* of the other sensors. Controller 162 stores the calibration test readings 456 of sensors 304, and future edge readings 422 taken during a normal operating mode 458 will be compared to test readings 456. If a set of edge readings 422 taken of board 16 during normal operation match the stored test readings 456, that would indicate that board 16 is as straight as the standard elongate member 454.

There are many possible ways of calibrating a set of sensors and different ways of using them for detecting the curvature of a board. In some examples, sensors 304 are calibrated using standard elongate member 454 in the form of a board 16 having an unknown curvature. In this example calibration method, board transfer means 306 conveys member 454 (board 16 of unknown curvature) in forward direction 442 across the full set of sensors 304*a-e*, and controller 162 records a first set of trigger timings of sensors 304 while member 454 is right-side-up.

Next, board flipper 305 turns member 454 over, board transfer means 306 conveys member 454 up-side-down for a second pass across sensors 304, and controller 162 records a second set of trigger timings of sensors 304. Since member 454 is inverted during the second pass, any curvature in member 454 should produce trigger timing readings that are substantially equal but opposite between the first and second set of recorded readings. An average of the two sets of readings is substantially equivalent to a single set of readings taken of a straight version of elongate member 454, so the average set of readings, as computed by controller 162, works well as a basis for calibrating the position of sensors 304 relative to a straight line. This calibration method eliminates the need for having to find a perfectly straight board for use as standard elongate member 454.

In some examples, not every sensor 304 is necessarily used in measuring the curvature of boards 16. For instance, in some examples, board transfer means 306 conveys each board 16 in a centrally justified orientation relative to the full set of sensors 304. Relatively long boards 16 are sufficiently long to trigger all five sensors 304*a-e*. Some shorter boards 16, however, might be too short to trigger outer sensors 304*a* and 304*e*. Nonetheless, all boards 16 trigger at least the three central sensors 304*b*, 304*c* and 304*d*. So, in some examples, the curvature of shorter boards 16 is calculated by controller 162 based on readings 422*b*, 422*c* and 422*d*. To benefit from the accuracy of using the outermost sensors 304*a* and 304*e*, in some examples, the curvature of longer boards is calculated based on readings 422*a*, 422*c* and 422*e*; and readings 422*b* and 422*d* are disregarded for simplicity.

Upon correctly identifying a curved board, various examples of board flipper 305 can be used for inverting the board prior to cutting it. In the example shown in FIGS. 20-24, board flipper 305*a* comprises at least one pivot arm 460 that rotates about a shaft 462 to turn a board over. If board 16 is sufficiently straight or curved in a direction that does not require the board to be turned over, pivot arm 460 remains in its stored position of FIG. 20, and transfer station 430 conveys board 16 directly over to board-receiving area 316, which delivers board 16 to saw 14.

Figure 21:
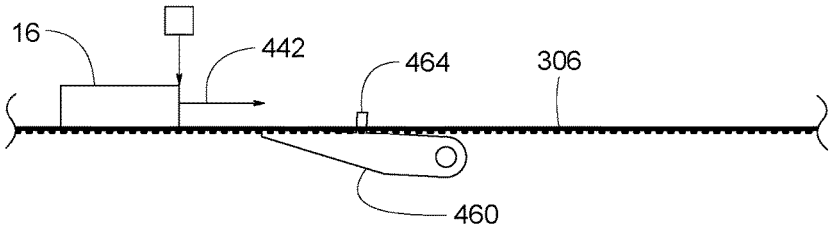
FIG. 21 is a schematic diagram of the board flipper shown in FIG. 20, wherein the board flipper is in a position to block the forward path of a board.
Figure 22:
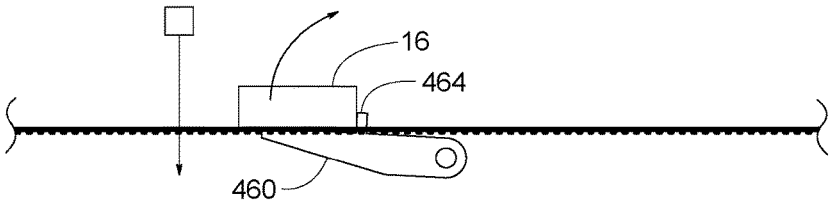
FIG. 22 is a schematic diagram showing the board flipper of FIG. 20 but showing the board flipper beginning to turn the board over.
Figure 23:
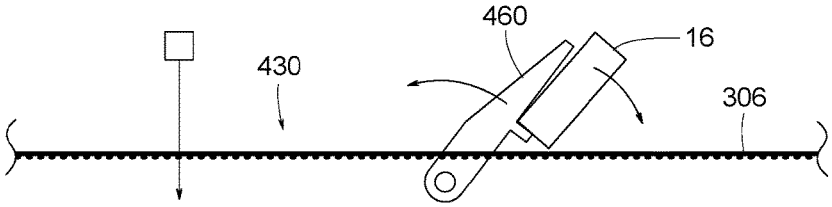
FIG. 23 is a schematic diagram showing the board flipper of FIG. 20 but showing the board flipper turning the board over.
Figure 24:
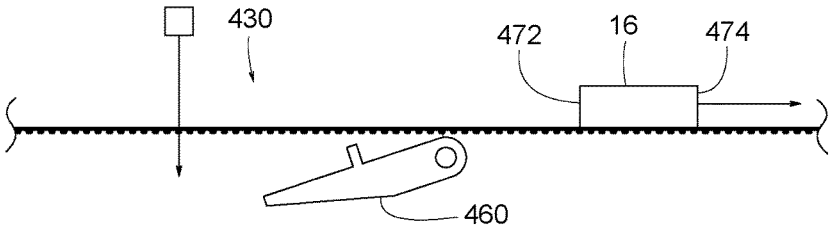
FIG. 24 is a schematic diagram showing the board flipper of FIG. 20 but showing the board flipper retracted to its stored position after having turned the board over.
Figure 25:
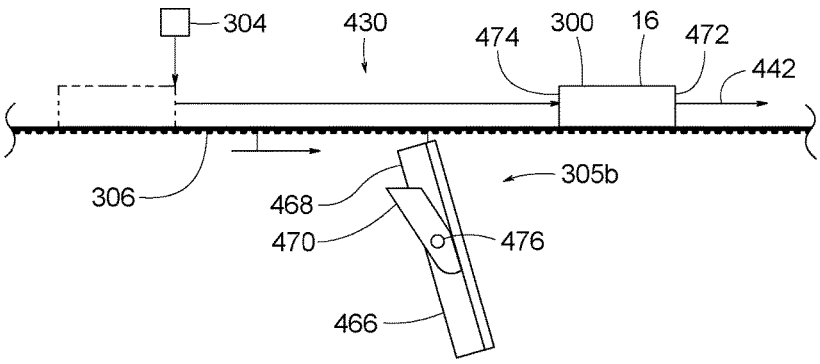
FIG. 25 is a schematic diagram similar to FIG. 20 but showing another example board flipper constructed in accordance with the teachings disclosed herein.

If sensors 304 detect that board 16 is significantly curved and needs to be turned over, as shown in FIG. 21, then pivot arm 460 rotates slightly to position a stop 464 in the path of board 16. FIG. 22 shows board 16 engaging stop 464 and pivot arm 460 beginning to turn board 16 over. FIG. 23 shows pivot arm 460 turning board 16 over and letting it fall up-side-down onto board transfer means 306 of transfer station 430. FIG. 24 shows pivot arm 460 having returned to its stored position while transfer station 430 passes board 16 onto board-receiving area 316.

In the example shown in FIGS. 25-31, board flipper 305*b* comprises at least one lift arm 466 that rises to turn a board over. If board 16 is sufficiently straight or curved in a direction that does not require the board to be turned over, lift arm 466 remains in its stored position of FIG. 25, and transfer station 430 conveys board 16 directly over to board-receiving area 316, which delivers board 16 to saw 14.

Figure 26:
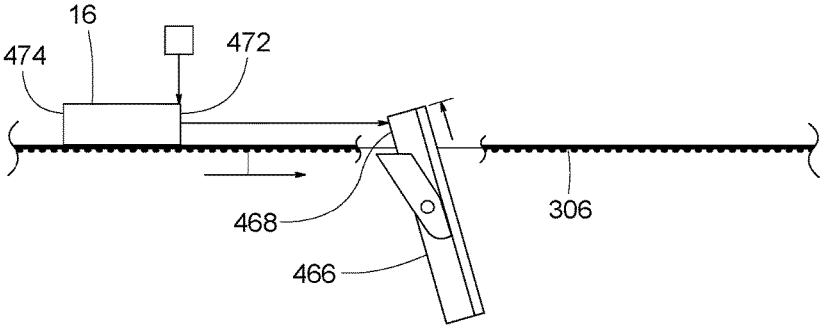
FIG. 26 is a schematic diagram of the board flipper shown in FIG. 25, wherein the board flipper is in a position to block the forward path of a board.
Figure 27:
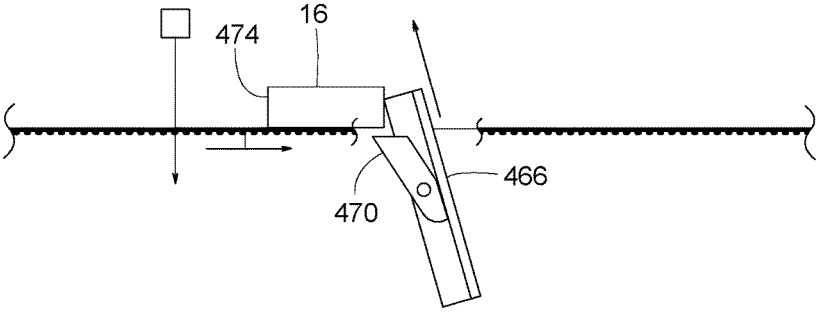
FIG. 27 is a schematic diagram showing the board flipper of FIG. 25 but showing the board flipper about to turn the board over.
Figure 28:
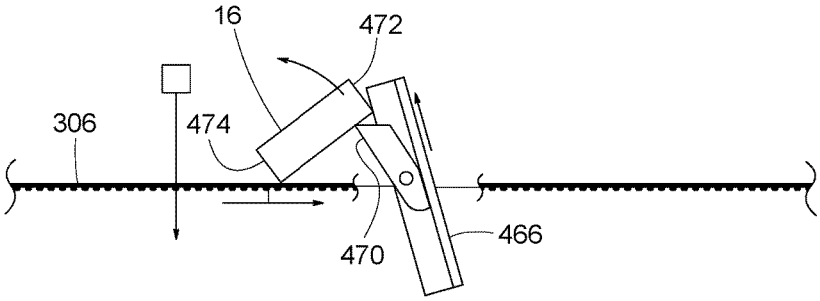
FIG. 28 is a schematic diagram showing the board flipper of FIG. 25 but showing the board flipper turning the board over.
Figure 29:
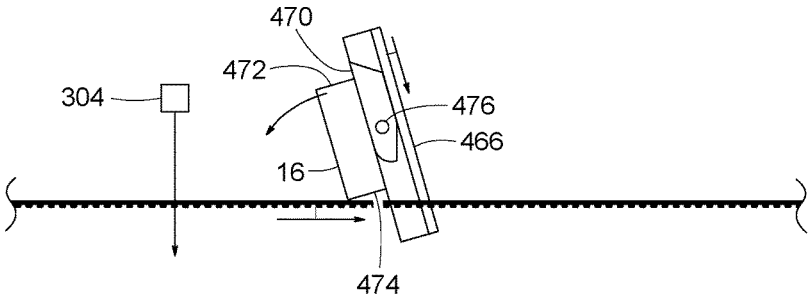
FIG. 29 is a schematic diagram similar to FIG. 28 but showing the board continuing to turn over.
Figure 30:
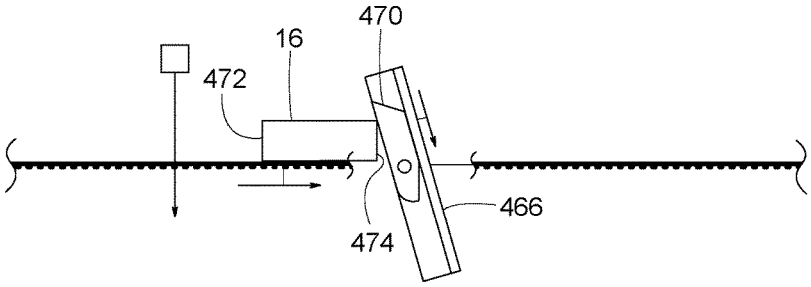
FIG. 30 is a schematic diagram showing the board flipper of FIG. 25 but showing the board flipper retracting while the board has already turned up-side-down.
Figure 31:
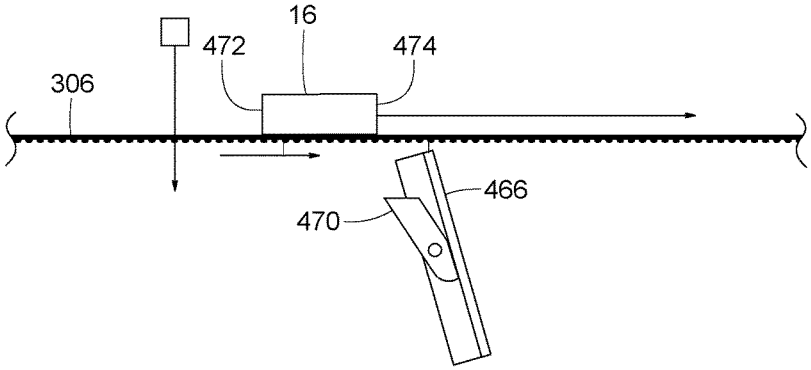
FIG. 31 is a schematic diagram similar to FIG. 31 but showing the board flipper fully retracted and showing the up-side-down board being conveyed in a forward direction toward a board-receiving area.
Figure 32:
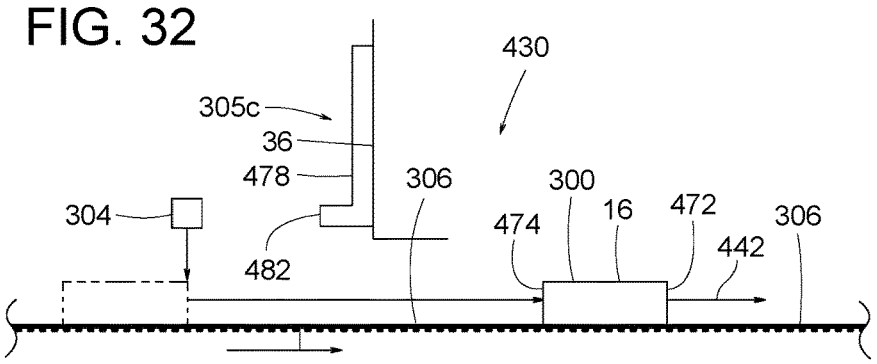
FIG. 32 is a schematic diagram similar to FIGS. 20 and 25 but showing yet another example board flipper constructed in accordance with the teachings disclosed herein.

If sensors 304 detect that board 16 is significantly curved and needs to be turned over, as shown in FIG. 26, then lift arm 466 rises slightly to position a stop 468 in the path of board 16. FIG. 27 shows board 16 engaging stop 468, while a pivotal finger 470 is in position to subsequently engage the underside of board 16. As lift arm 466 rises from the position shown in FIG. 27 to the position shown in FIG. 28, finger 470 starts lifting a leading edge 472 of board 16 while board transfer means 306 moves the board's trailing edge 474 toward lift arm 466. FIG. 29 shows lift arm 466 fully extended and beginning to retract. In this fully extended position, the board's once trailing edge 474 is now up against lift arm 466, and the board's once leading edge 472 begins falling back down. A pin 476 allows board 16 to pivot finger 470 back to a retracted position relative to the main body of lift arm 466. FIG. 30 shows board 16 having been turned over to its up-side-down position and shows lift arm 46 retracting. FIG. 31 shows lift arm 466 back at its fully retracted, stored position, which allows board transfer means 306 to move the now up-side-down board 16 toward board-receiving area 316.

In the example shown in FIGS. 32-37, board flipper 305*c* comprises at least one pick arm 478 supported by trolley 36. Pick arm 478 can move vertically relative to trolley 36 and rises to turn a board over. If board 16 is sufficiently straight or curved in a direction that does not require the board to be turned over, pick arm 478 remains in its elevated stored position of FIG. 32, and transfer station 430 conveys board 16 directly over to board-receiving area 316, which delivers board 16 to saw 14.

Figure 33:
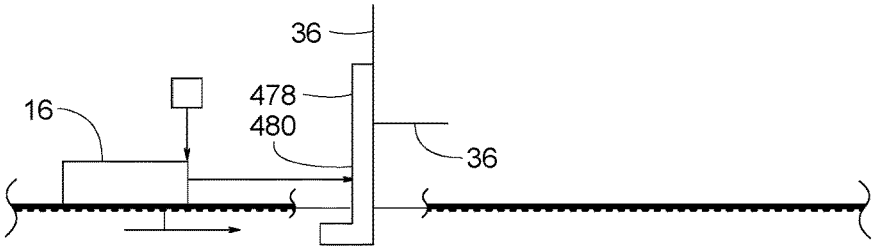
FIG. 33 is a schematic diagram of the board flipper shown in FIG. 32, wherein the board flipper is in a position to block the forward path of a board.
Figure 34:
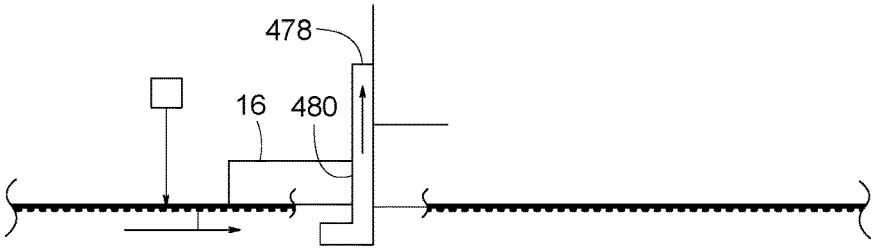
FIG. 34 is a schematic diagram showing the board flipper of FIG. 32 but showing the board flipper about to turn the board over.
Figure 35:
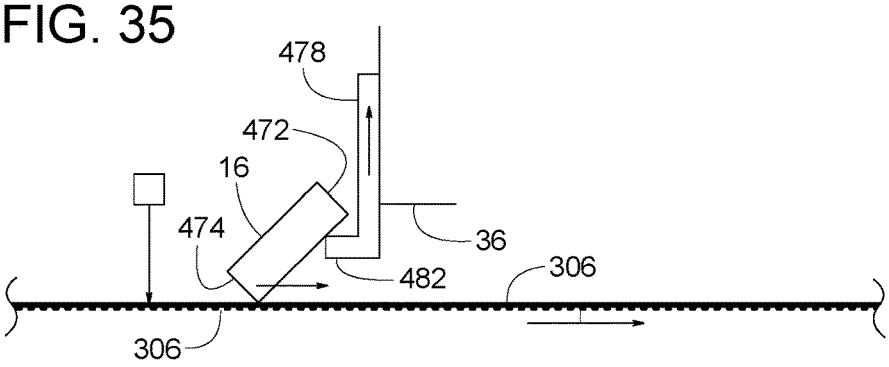
FIG. 35 is a schematic diagram showing the board flipper of FIG. 32 but showing the board flipper turning the board over.
Figure 36:
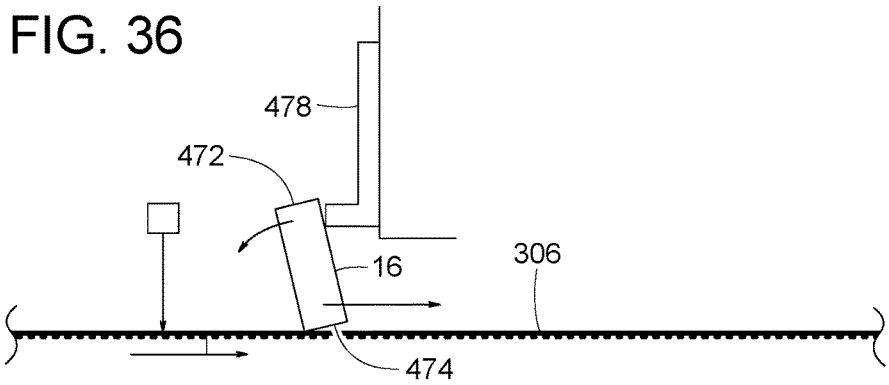
FIG. 36 is a schematic diagram similar to FIG. 32 but showing the board continuing to turn over.
Figure 37:
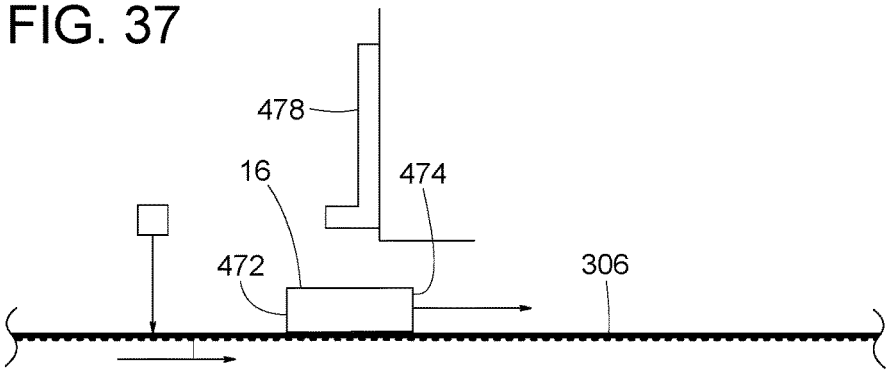
FIG. 37 is a schematic diagram similar to FIG. 36 but showing the board flipper fully retracted and showing the up-side-down board being conveyed in a forward direction toward a board-receiving area.
Figure 38:
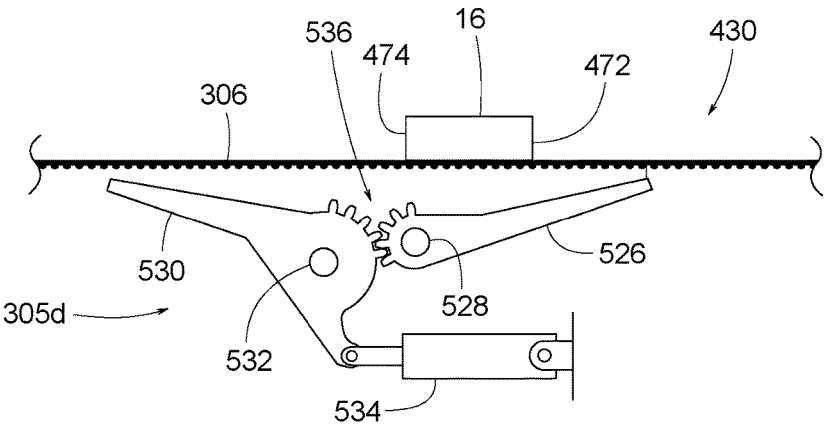
FIG. 38 is a schematic diagram similar to FIG. 20 but showing another example board flipper constructed in accordance with the teachings disclosed herein.

If sensors 304 detect that board 16 is significantly curved and needs to be turned over, as shown in FIG. 33, then pick arm 478 descends to position a stop portion 480 of arm 478 in the path of board 16. FIG. 34 shows board 16 engaging stop portion 480, while a lip 482 is in position to subsequently engage the underside of board 16. As pick arm 478 rises from the position shown in FIG. 34 to the position shown in FIG. 35, lip 482 starts lifting leading edge 472 of board 16 while board transfer means 306 moves the board's trailing edge 474 forward toward board-receiving area 316. FIG. 36 shows pick arm 478 fully retracted to its stored position. With pick arm 478 in its fully retracted, stored position, board transfer means 306 moves the board's once trailing edge 474 forward underneath pick arm 478 while the board's once leading edge 472 begins falling back down. FIG. 37 shows board 16 having been turned over to its up-side-down position, as board transfer means 306 moves the now up-side-down board 16 toward board-receiving area 316.

In the example shown in FIGS. 38-43, board flipper 305*d* comprises at least one tilting arm 526 that rotates about a shaft 4 528 to pivotally lift and turn board 16 over and at least one return arm 530 that rotates about a shaft 532 to controllably lower board 16 back down onto board transfer means 306. If board 16 is sufficiently straight or curved in a direction that does not require the board to be turned over, tilting arm 526 and return arm 530 remain in their retracted stored position (shown in FIG. 38) so that transfer station 430 can convey board 16 directly over to board-receiving area 316, which delivers board 16 to saw 14.

Figure 39:
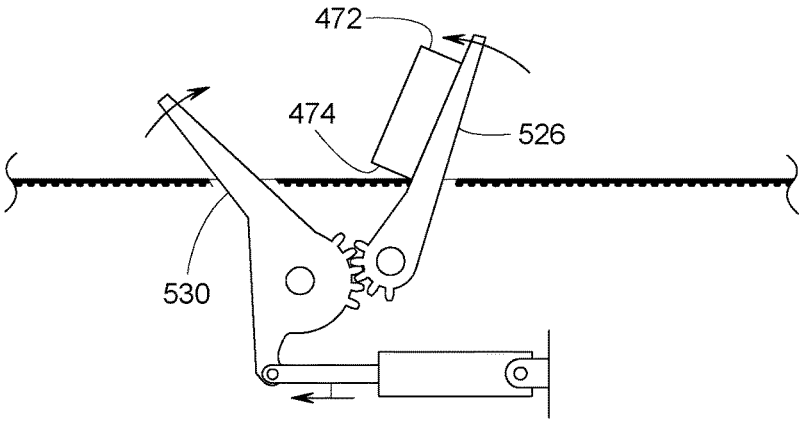
FIG. 39 is a schematic diagram of the board flipper shown in FIG. 38, wherein the board flipper is in the process of turning a board over.
Figure 43:
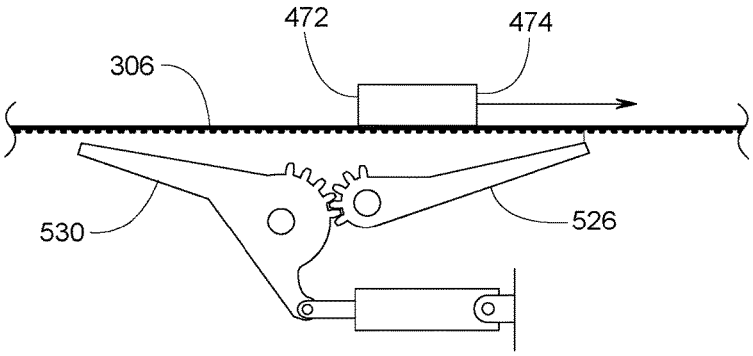
FIG. 43 is a schematic diagram similar to FIG. 38 but showing the board flipper having turned the board over.

If sensors 304 detect that board 16 is significantly curved and needs to be turned over, then controller 162 commands an actuator 534 (e.g., pneumatic cylinder, hydraulic cylinder, linear motor, etc.) to pivot tiling arm 526 upward, as shown in FIG. 39, which begins the process of turning board 16 from being right-side-up (FIG. 38) to being up-side-down (FIG. 43).

Meshing gear teeth 536 drive and coordinate the rotational movement of both arms 526 and 530. In the illustrated example, the gear pitch diameters of arms 526 and 530 are such that tilting arm 526 rotates farther than return arm 530. This allows tilting arm 526 to pivot board 16 past the board's tipping point so that board 16 can fall over onto return arm 530.

Figure 40:
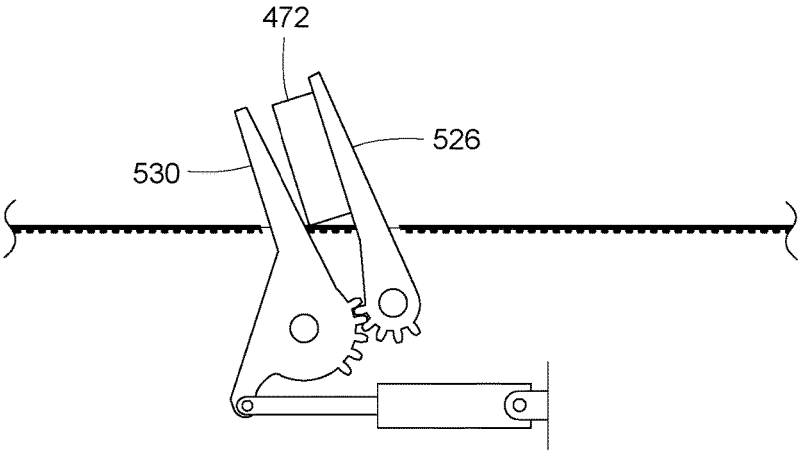
FIG. 40 is a schematic diagram similar to FIG. 39 but showing the board flipper further along in the process of turning the board over.
Figure 41:
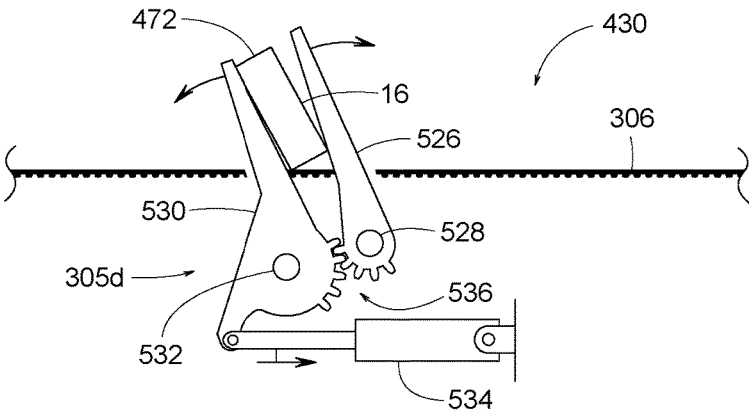
FIG. 41 is a schematic diagram similar to FIG. 40 but showing the board having tipped from an example tilting arm over onto an example return arm.
Figure 42:
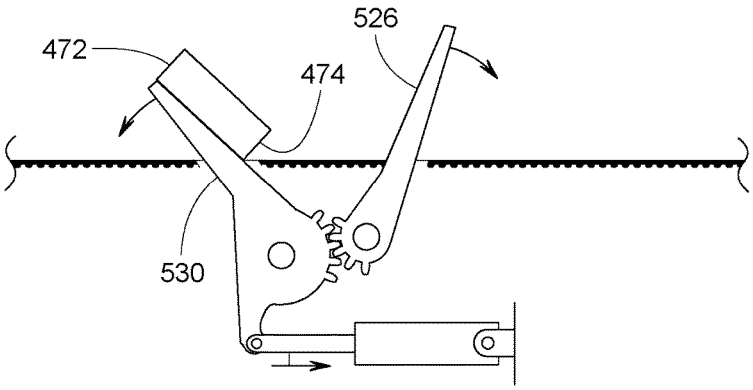
FIG. 42 is a schematic diagram similar to FIG. 41 but showing the return arm lowering the board while the tilting arm returns to its retracted stored position.

FIGS. 40 and 41 show arms 526 and 530 fully extended such that board 16 tips from being against tilting arm 526 (shown in FIG. 42) to being against return arm 530 (shown in FIG. 41). FIG. 42 shows arms 526 and 530 retracting. As return arm 530 retracts, it controllably lowers board 16 up-side-down onto board transfer means 306. When arms 526 and 530 are fully retracted, as shown in FIG. 43, board transfer means 306 conveys the now up-side-down board 16 onto board-receiving area 316.

Regarding a lumber handling method employing lumber retrieval system 10', arrow 484 of FIG. 11 represents placing board 16 right-side-up at first station 310*a*. Arrow 486 of FIG. 11 represents using trolley 36 for transferring board 16 in forward direction 442 (FIG. 7) from first station 310*a* toward board receiving area 316, wherein forward direction 442 is substantially perpendicular to the board's length 488 (FIG. 13). A block 490 of FIG. 10 represents controller 162 defining a predetermined positive limit of curvature 492. In some examples, controller 162 defines the predetermined positive limit of curvature 492 based on a user inputting that information, as indicated by arrow 494 of FIG. 10. The predetermined positive limit of curvature is with reference to how far a board's crown protrudes in forward direction 442 toward board-receiving area 316. Conversely, a predetermined negative limit of curvature is with reference to how far a board's crown protrudes in rearward direction 444 away from board-receiving area 316.

The term, "curvature" and "limit of curvature" is generally the inverse of a radius at which a board curves about an axis that is perpendicular to the broadest face of the board. Thus, a relatively large curvature means the board curves at a relatively small radius. Conversely, a relatively small curvature means the board curves at a relatively large radius. Alternatively, an offset distance 496 (FIG. 13) is a comparable means for expressing a board's curvature, wherein the magnitude of offset distance 496 is generally proportional to the magnitude of the board's curvature.

Block 498 of FIG. 10 represents sensors 304 in conjunction with controller 162 detecting whether board 16 has a board curvature 500 exceeding the predetermined positive limit of curvature 492. In some examples, sensors 304 sensing a plurality of points 502 along a leading or trailing edge of board 16 generates a plurality of edge readings 422. In examples where sensors 304 are calibrated (e.g., as shown in FIG. 19), edge readings 422 are compared in block 504 to a plurality of test readings 456 (sampled during the calibration process) to get an accurate representation of the board's true magnitude and direction of board curvature 500. In block 498, controller 162 compares board curvature 500 to the predetermined positive limit of curvature 492. In some examples, before cutting a board segment 16*a* from board 16, controller 162 determines whether to turn board 16 up-side-down. Block 498 of controller 162 further represents controller 162 determining whether to turn board 16 up-side-down based on whether board curvature 500 exceeds the predetermined positive limit of curvature 492.

Arrow 426 of FIG. 10 represents using saw 14 for cutting board 16 into board segment 16*a* with board 16 right-side-up if the board curvature 500 is less than the predetermined positive limit of curvature 492. FIGS. 23, 28 and 35 illustrate mechanically turning board 16 up-side-down. The term, "mechanically turning the board up-side-down" means that the board is inverted by a device rather than inverted manually. Arrow 424 of FIG. 13 represents using saw 14 for cutting board 16 into board segment 16*a* with board 16 up-side-down if board curvature 500 exceeds the predetermined positive limit of curvature 492. Arrow 122 of FIG. 10 represents assembling structural board assembly 127 incorporating board segment 16*a*.

In some examples, the decision whether to flip a curved board is based not only the magnitude and direction of board curvature 500 but also the intended location where board segment 16*a* will be used on structural board assembly 127. Arrow 506 of FIG. 10 represents defining a designated location of board segment 16*a* for use in structural board assembly 127. In some examples, "defining a designated location" is done by a user inputting that information (e.g., via inputting a truss design 508) into controller 162. In other words, in some examples, before cutting board segment 16*a* from board 16, controller 162 determines whether to turn board 16 up-side-down based on whether board curvature 500 exceeds the predetermined positive limit of curvature 492 and further based on the designated location of board segment 16*a* in structural board assembly 127. Thus, in some examples, block 498 of controller 162 further represents determining whether to turn board 16 up-side-down based on whether board curvature 500 exceeds the predetermined positive limit of curvature 492 and doing so before cutting board segment 16*a* from board 16.

In some examples, arrow 510 represents commanding board flipper 305 to turn board 16 up-side-down or to leave board 16 right-side-up. As an alternative to turning board 16 over, the cutting direction of saw 14 can be changed accordingly. In some examples, for instance, arrow 512 represents a signal indicating whether there is a need for turning board 16 over. Block 514 of FIG. 10 represents controller 162 interpreting the need for turning board 16 over, and arrow 516 represents controller 162 redirecting saw 14 to cut in a different direction 446*a* (mirror image of cut 446*b*) such that the resulting board segment 16*a* would be the same as if board 16 had been turned over.

In some examples, arrows 422' represent generating a plurality of edge readings 422 by sensing a plurality of points 502 along an edge 516 of board 16 with a plurality of sensors 304 that are spaced apart along the length 488 of board 16. Block 498 represents, based on the plurality of edge readings 422, determining whether board curvature 500 exceeds the predetermined positive limit of curvature 492. FIG. 19 illustrates calibrating the plurality of sensors 304 by positioning (arrow 518) standard elongate member 454 within sensing proximity of the plurality of sensors 304. Arrows 456*a-e* represent generating a plurality of test readings 456 by sensing a plurality of test points 520 along a leading or trailing edge of standard elongate member 454. Block 504 of FIG. 10 represents referring to the plurality of test readings 456 to compensate for possible linear misalignment of the plurality of sensors 304.

In some examples, one or more marks (e.g., a first mark 434*a* and/or a second mark 434*b*) are applied to board 16 to denote a concave or convex edge. Such marks can assist a worker in assembling and later inspecting structural board assembly 127. Arrow 522 of FIG. 11 represents if board 16 has a convex edge, automatically applying mark 434*a* on the board's convex edge. Arrow 524 of FIG. 11 represents if board 16 has a concave edge, automatically applying mark 434*b* on the board's concave edge. In some examples, marks 434*a* and 434*b* are distinguishable from each other by some notable feature, examples of which include, but are not limited to, color, size, pattern, shape, etc.

In some examples of a lumber handling method employing lumber retrieval system 10', block 498 of FIG. 10 further represents determining whether to cut board 16 in a first direction 446*b* or a second direction 446*a* based on whether board curvature 500 exceeds the predetermined positive limit of curvature 492, wherein first direction 446*b* is substantially a mirror image of second direction 446*a*. FIG. 13 illustrates using saw 14 for cutting board 16 in first direction 446*b* to create board segment 16*a* if board curvature 500 is less than the predetermined positive limit of curvature 492. FIG. 13 also illustrates using saw 14 for cutting board 16 in second direction 446*a* to create board segment 16*a* if board curvature 500 exceeds the predetermined positive limit of curvature 492.

It should be appreciated by those of ordinary skill in the art that saw 14 is schematically illustrated and that saw 14 may include additional hardware, examples of which include, but are not limited to, guides, tracks, rollers, guards, vents, clamps, backstops, a fence, a table, etc. Moreover, board 16 may be biased over to one side of the saw table rather than at an unrestrained or unguided position.

Figure 5:
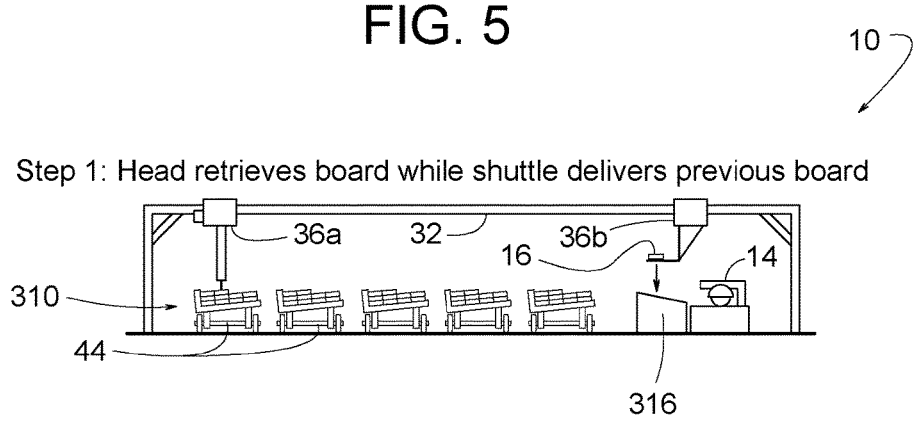
FIG. 5 is a series of diagrams showing a side view of various example systems and methods for automatic lumber retrieval systems in accordance with the teachings disclosed herein.

Main Trolley Plus Shuttle Trolley (FIG. 5)

In some examples, a lumber retrieval system's delivery speed is limited by the horizontal travel time required to deliver a board to the process and return to the position of the next board. Longer systems containing more lumber stacks are desirable from a quantity and variety standpoint but require longer delivery cycle time. Simply speeding up the travel speed can improve this, but maximum speed is limited by several factors. One factor is the required mechanical construction and electric motor power requirements to accelerate and decelerate the trolley and board combination. The most critical factor is one of safety. High speeds can cause machine damage in a runaway condition, but more importantly, can create danger to personnel. Higher speeds almost always increase emergency stopping time and also increase the severity of injury should an accident occur. Therefore, it is advantageous to operate the retrieval system at lower speeds while still maintaining high board delivery rates to the end process.

One design to take advantage of low speed movement with high delivery rates uses a lumber shuttle (shuttle trolley 36*b*) to deliver lumber 16 to the process (e.g., saw 14) while a main trolley 36*a* and board picking head 184 combination are picking up the next board 16. In some examples, lumber shuttle 36*b* operates on the same track 32 as the trolley 36*a* and picking head. Trolley 36*a* and shuttle 36*b* are equipped with independent motors and can freely move along track 32. The lumber shuttle 36*b* is equipped with a lumber receiving device 308 that can transport one or more boards. Boards picked up from one station 310 by the trolley and picking head combination 36*a* are transferred (handed off) to shuttle 36*b* at variable locations on track 32. Lumber shuttle 36*b* then transports a single board 16 or multiple boards 16 to a board receiving area 316 to feed saw 14 or other process. During the lumber shuttle delivery process, the trolley and picking head 36*a* are free to pick up another board 16. If the lumber shuttle 36*b* has not returned when the next board 16 is ready to be handed off, trolley 36*b* is directed to move towards the trolley's receiving/hand-off area 316. Controller 162 controlling the system calculates the optimal hand off point (based on saving the most time) and directs trolley 36*a* and lumber shuttle 36*b* to meet at that point. If controller 162 determines that no time will be saved with a hand off, the hand off is canceled, and lumber shuttle 36*b* will move out of the trolley's way to allow trolley 36*a* to complete the delivery to receiving area 316 that, for example, feeds saw 14. It can be seen that working together in this manner is of great benefit especially if the travel distances involved are long.

The shuttle system described can receive multiple boards 16 in one hand off or multiple boards in multiple hand offs and deliver them to board receiving area 316. Another variation of this design includes two separate lumber shuttles 36*b* on opposite sides of trolley 36*a*. Each shuttle 36*b* would feed receiving area 316 for an individual process located at each end of the lumber delivery system.

In some examples, a lumber handling method of using a main trolley and a shuttle trolley for transferring a board from a station toward a saw, the lumber handling method is defined as comprising: the main trolley conveying the board from the station toward the shuttle trolley; and the shuttle trolley conveying the board from the main trolley toward the saw.

FIGS. 6-9 show various methods for setting up, calibrating and operating lumber handling system 10. These illustrations show system 10 comprising a track/trolley system 342, laser unit 284, a saw system 314, controller 162, and plurality of stations 310.

Stations 310 are for supporting a stack of lumber (e.g., first stack 146 and second stack 152) each comprising a plurality of boards 16. In the illustrated example, a first station 310*a* has first stack of lumber 146 comprising a first plurality of boards 144, and second station 310*b* has second stack of lumber 152 comprising a second plurality of boards 150. In some examples, the first plurality of boards 144 are of a different size than that of the second plurality of boards 150. Boards 144, for example, might be 2×4's while boards 150 are 2×6's. In another example, boards 144 and 150 might both be 2×4's but be of different lengths. In still other examples, boards 144 and 150 might be identical in size. In any case, stations 310 provide a supply of boards 16 to be processed by saw system 314.

Each station of the plurality of stations 310 comprises at least one of a parking spot 343 on floor 340, a lumber support 44 (e.g., a cart) on parking spot 343, and a board 16 on the cart or on some other type of lumber support. In some examples, a station 310 is just parking spot 343. In some examples, a station 310 is parking spot 343 plus a cart on parking spot 343, wherein no lumber is on the cart. In some examples, a station 310 is parking spot 343, a cart on parking spot 343, and at least one board 16 on the cart. Plurality of stations 310 includes at least first station 310*a* and second station 310*b*. The example illustrated in FIGS. 6-9 shows the plurality of stations 310 also having third station 310*c* and can actually have many more stations as well.

Track/trolley system 342 is for retrieving chosen boards 16 from stations 310 and delivering them to board-receiving area 316 that feeds saw 14. Track/trolley system 342 comprises at least one overhead track 32 and at least one trolley apparatus 36' that travels along track 32. Trolley apparatus 36' includes one or more trolleys 36. In some examples trolley apparatus 36' is a single trolley 36 carrying a board picker 184 (e.g., board picker 184*a* and 184*b*) and laser unit 284. Board picker 184 is schematically illustrated to represent any apparatus capable of lifting board 16 up from a lumber support or stack of lumber. Examples of board picker 184 include, but are not limited to, piercing tools, suction cups, hooks, grippers, etc. In some examples trolley apparatus 36' includes a first trolley for carrying board picker 184 and a separate second trolley for carrying laser unit 284. In some examples, drive system 272 (FIG. 2) moves trolley apparatus 36' along track 32 in response to an output signal 282 from controller 162. Controller 162 receives a feedback signal 267 from laser unit 284.

Laser unit 284 is primarily for finding the right board from the right station. Laser unit 284 is schematically illustrated to present any device that emits laser beam 156 for sensing a distance between a surface and the laser emitting device. An example of laser unit 284 includes, but is not limited to, a model RF603-260/1250-232-I-IN-AL-CC-3 laser triangulation position sensor provided by Riftek of Minsk, Russia. Input 267 and output 288 schematically represent control communication between controller 162 and laser unit 284. Upon scanning the upper surface profile of stacks of lumber, laser unit 284 identifies the location of each stack of lumber relative to each other and in relation to board receiving area 316 because controller 162 being in communication with laser unit 284 and a drive system 272 that moves trolley 36 can correlate laser scan readings with the position of the trolley's board picker 184.

Saw system 314 comprises board receiving area 316 and at least one saw 314 for cutting boards to size. Board receiving area 316 is schematically illustrated to represent any structure for receiving boards 16 from trolley apparatus 36' and transferring those boards to saw 14. Examples of board receiving area 316 include, but are not limited to, a conveyor, a ramp, a chute, a part transfer mechanism, board turning device 305, and various combinations thereof. Saw 14 cuts the boards received from area 316 to create a kit of cut boards 344 (e.g., pieces 112, 114, 116, 118 and 120) that are assembled to create a structural board assembly 127 (e.g., roof truss 126 or wall panel 128). In some examples, a plurality of structural board assemblies 127 are grouped as specified in a job order 330 that is entered into controller 162. Job order 330, for example, might specify a certain group of structural board assemblies 127 that are intended to be shipped to a particular customer or job site.

Controller 162 is schematically illustrated to present any electrical device able to provide various outputs in response to various inputs. In response to the inputs, controller 162 controls various components of system 10 including, but not limited to, controlling drive system 272 of trolley system 342, controlling board picker 184 and various actuators thereof, controlling laser unit 284, and controlling digital display 188 (e.g., a touchscreen). Examples of controller 162 include, but are not limited to, a single computer, a system of multiple computers, a single PLC (programmable logic controller), a system of multiple PLCs, various combinations of one or more computers and PLCs, and various combinations of computers, PLCs, sensors, laser units, switches, touchscreens, relays, etc. A specific example of controller 162 is a model CP6201-0001-0200 industrial computer by Beckhoff of Verl, Germany.

The lower portions of FIGS. 6 and 7 show a basic flow chart or algorithm that illustrates some example data processing functions of controller 162. In many cases, these data processing functions are part of some example lumber handling methods that pertain to lumber handling system 10. At least one such lumber handling method and system will now be further described with reference to the drawing figures.

FIGS. 2 and 6-9 illustrate carrying laser unit 284 above and over the plurality of stations 310 via trolley apparatus 34' of track/trolley system 342, wherein track/trolley system 342 comprises trolley apparatus 36' and track 32 along which trolley apparatus 36' travels. Arrow 346 of FIG. 6 represents trolley apparatus 36' moving laser beam 156 over stations 310, which illustrates determining a plurality of floor-to-track error values 348 (e.g., plurality of laser calibration readings 348*a* or a plurality of vertical distance readings 348*b*) that vary based on floor 340 and track 32 deviating from being parallel to each other. Example means for measuring the track-to-floor deviations or error values 348 include, but are not limited to, laser scanning the height of a certain lower target point 350 on each cart, laser scanning a single board 16 on each cart, and manually measuring 355 a vertical distance 352 from some upper reference point 354 on trolley apparatus 36' to lower target point 350 of each cart (or to lower target point 350' on a single board 16 or to lower target point 350" on floor 340). Arrow 360 illustrates recording the plurality of floor-to-track error values 348 on controller 162.

In some examples, a laser calibration reading is a substantially vertical distance of the laser beam between the laser unit and a laser beam obstruction. In some examples, the laser calibration reading is measured directly by the laser unit. A vertical distance reading is a manually measured, substantially vertical distance from an upper reference point (e.g., face of the laser unit, fixed point on the frame of the trolley apparatus, etc.) to a lower target point (e.g., floor itself, frame of the cart, a board resting on the cart, etc.), wherein the upper reference point is substantially fixed vertically relative to the laser unit, and the lower target point is directly below the upper reference point Arrow 362 of FIG. 7 represents scanning the plurality of stations 310 with laser unit 284 as trolley apparatus 36' carries laser unit 284 over the plurality of stations 310 during a normal operating period. The normal operating period is when laser unit 284 repeatedly scans stations 310 for the purpose of finding a board 16 to be retrieved from the right station 310 and for monitoring the number of boards at each station 310. Arrow 364 represents recording a plurality of lumber scanned readings 366 via controller 162 as a result of scanning the plurality of stations 310 during the normal operating period. Block 368 represents calculating a plurality of error-compensated readings 370 via controller 162 based on a comparison or difference of lumber scanned readings 366 and the plurality of floor-to-track error values 348.

The top portion of FIG. 7 shows storing first stack of lumber 146 at first station 310*a*, wherein first stack of lumber 146 comprises the first plurality of boards 144 each of a first board size 371 (e.g., 2×4). Arrow 372 represents entering first board size 371 into controller 162. The top portion of FIG. 7 also shows storing second stack of lumber 152 at second station 310*b*, wherein second stack of lumber 152 comprises the second plurality of boards 150 each of a second board size 374 (e.g., 2×6) that is distinguishable from first board size 371. Arrow 376 represents entering second board size 374 into controller 162.

Block 378 represents controller 162 calculating a first quantity of boards 380 of first plurality of boards 146 based on the plurality of error-compensated readings 370 and first board size 371. Readings 370 identify a fairly accurate cross-sectional area of each stack of lumber, and dividing that by the cross-sectional area of a single board provides the number of boards in that stack. Block 382 represents controller 162 calculating a second quantity of boards 384 of second plurality of boards 150 based on the plurality of error-compensated readings 370 and second board size 374.

Figure 8:
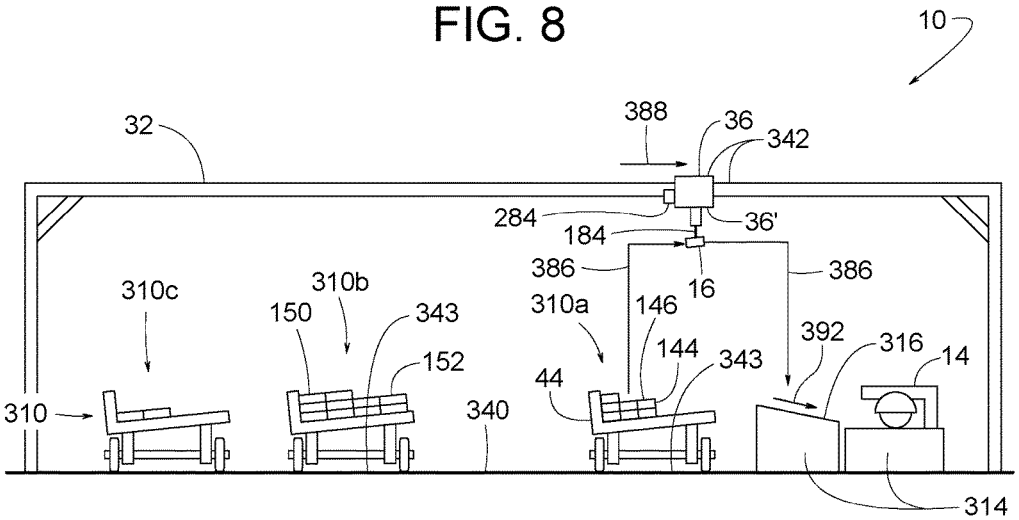
FIG. 8 is a schematic diagram showing an example method of operation of the automatic lumber retrieval system shown in FIGS. 6 and 7.
Figure 9:
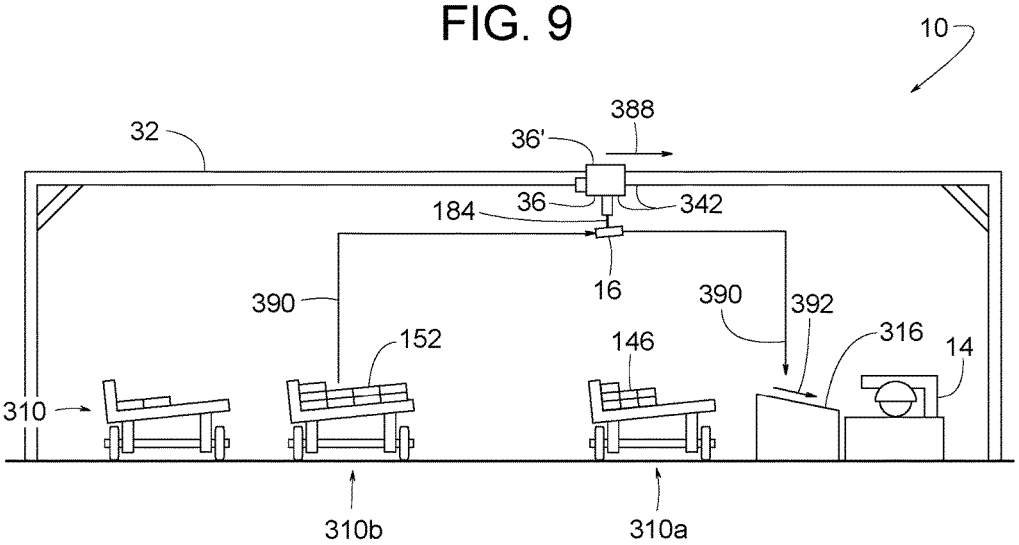
FIG. 9 is a schematic diagram showing another example method of operation of the automatic lumber retrieval system shown in FIGS. 6 and 7.

In FIG. 8, arrows 386 illustrate track/trolley system 36' carrying a first board 16 along a trolley travel direction 388 from first station 310*a* to board-receiving area 316, wherein first station 310*a* is between second station 310*b* and board-receiving area 316. Trolley travel direction 388 is substantially parallel to track 32. Arrows 390 of FIG. 9 represents track/trolley system 36' carrying a second board 16 along trolley travel direction 388 from second station 310*b*, over first station 310*a*, and to board-receiving area 316. Arrow 392 of FIGS. 2, 8 and 9 represents transferring boards 16 from board-receiving area 316 to saw 14.

FIG. 6 illustrates an example laser-scanning method for automatically calibrating system 10 to compensate for floor 340 and track 32 deviating from parallel alignment with each other. The trolley's travel movement, as indicated by arrow 362, and laser beam 156 detecting lower target point 350 (e.g., point 350 on the cart or point 350' on a single board 16 or point 350" on floor 340) at each station 310 represents scanning the plurality of stations 310 with laser unit 284 as trolley apparatus 36' carries laser unit 284 in the trolley travel direction 388 over stations 310 during a calibration period (FIG. 6) that occurs before the normal operating period (FIG. 7). Upon scanning 362 the plurality of stations 310 during the calibration period, controller 162 records a plurality of laser calibration readings 348*a* that vary as a result of floor 340 and track 32 deviating from being parallel to each other.

Alternatively, FIG. 6 illustrates an example manual means for calibrating system 10 to compensate for floor 340 and track 32 deviating from parallel alignment with each other. The trolley's travel movement, as indicated by arrows 362 and 388 and dimension 350 or 352' extending from an upper point 354 on trolley apparatus 36' to lower target point 350, 350' or 350" represents selectively positioning trolley apparatus 36' to a plurality of locations along trolley travel direction 388. Tape measure 355 and dimension 352 (alternatively dimension 352') represents manually measuring a plurality of vertical distance readings from upper reference point 354 to lower target point 350 (or point 350' or point 350") at each station 310, and doing so during a calibration period (FIG. 6) that occurs before the normal operating period (FIG. 7), wherein upper reference point 354 is substantially fixed vertically and horizontally relative to laser unit 284, and lower target point 350 (or point 350' or point 350") is substantially directly underneath upper reference point 354 when vertical distance 352 is measured. Lower target point 350 (or point 350' or point 350") is substantially fixed horizontally with reference to upper reference point 350 (at the time of manual measurement), and lower target point 350 is at a substantially fixed vertical distance from floor 340 at a localized area 394 directly beneath lower target point 350. Arrow 396 represents manually entering the plurality of vertical distance readings 352 into controller 162, wherein readings 352 vary as a result of floor 340 and track 32 deviating from being parallel to each other, and the plurality of floor-to-track error values 348*b* are determined based on the plurality of vertical distance readings 350.

Arrow 362 and the various positions of trolley apparatus 36', as shown in FIG. 7, represents scanning the plurality of stations 310 at least once with laser unit 284 as trolley apparatus 36' carries laser unit 284 over the plurality of stations 310. FIG. 2 shows controller 162 creating an elevation profile map 164 of the plurality of stations 310 in response to laser unit 284 scanning the plurality of stations 310. Laser beam 156' shown in FIG. 6 and/or FIG. 7 represents detecting a gap 334 exceeding a predetermined width between first station 310*a* and second station 310*b* by scanning the plurality of stations 310 with laser unit 284. Section 398 of digital image 164 represents controller 162 noting the location of gap 334 and defining a relative location of first station 310*a* and/or second station 310*b* relative to each other based on the location of gap 334. Controller 162 noting a location of gap 334 means that controller 162 at least temporarily records, stores or pays particular attention to the location of gap 334.

In some examples, gap 334 is detected automatically by laser unit 284 and controller 162. In other examples, gap 334 is detected with the assistance of a worker observing when laser beam 156 enters gap 334. For instance, in some examples, detecting gap 334 exceeding a predetermined width is achieved through a manual visual observation 400 of laser unit 284, trolley system 36', and/or laser beam 156' as laser unit 284 scans the plurality of stations 310. Arrow 402 of FIG. 6 and FIG. 7 represents manually entering the location of the gap into controller 162.

Arrow 404 of FIGS. 6 and 7 represents defining a job order 330 that specifies making a certain set of structural board assemblies 127 of a predetermined quantity. For example, a job order 330 might specify making ten roof trusses 26 and four wall panels 128. Arrow 404 also represents entering job order 330 into controller 162. Block 406 represents controller 162 determining whether the first plurality of boards 144 and the second plurality of boards 150 are of sufficient quantities to satisfy the requirements of job order 330. Lights 408 (e.g., lights 408*a*, 408*b* and 408*c*) serve as an alert that identifies which if any stations 310 have an insufficient quantity of boards for job order 330. In the example illustrated in FIG. 7, lights 408*b* and 408*c* indicate that stations 330*b* and 330*c* need more boards. In some examples, lights 410 (e.g., lights 410*a*, 410*b* and 410*c*) serve as a notice that identifies which of the plurality of stations 310 will most likely need to be replenished first based on the current and upcoming job orders and the quantity of boards in the various stacks of lumber. In the illustrated example, light 410*b* indicates second station 310*b* will be the first needing to be replenished, even though third station 310*c* has fewer boards.

In some examples, when the actual board size of a stack of lumber is known, digital profile 164 can be enhanced to create a digital image showing not only the outline or elevation profile map of the stack but also showing individual boards within the stack. The lower portion of FIG. 7 shows screen 188 of controller 162 displaying a first image 190*a* depicting first stack of lumber 146 based on the elevation profile map 164 and the first board size, wherein first image 190*a* shows a first plurality of individual boards within the first stack of lumber 146. Likewise, controller 162 displays a second image 190*b* depicting the second stack of lumber 152 based on elevation profile map 164 and the second board size, wherein second image 190*b* shows a second plurality of individual boards within the second stack of lumber 152.

In FIG. 2, arrows 412 and 414 are examples illustrating saw 14 cutting at least a first board 112 and a second board 114 to create a kit of cut boards 315. Arrows 122 represent assembling the kit of cut board 314 to create a structural board assembly 127.

The laser scanning process shown in FIG. 6 illustrates determining the first board size (board width) by scanning a first individual board 16 of the first plurality of boards 144, and determining the second board size (board width) by scanning a second individual board 16 of the second plurality of boards 150. The board size is determined based on how far trolley apparatus 36' travels from a front edge of the board to the back edge of the board. In some examples, the board's vertical thickness is assumed to be a nominal two inches (e.g., about 1.5 inches).

Although certain example methods, apparatus and articles of manufacture have been described herein, the scope of the coverage of this patent application is not limited thereto. On the contrary, this patent application covers all methods, apparatus and articles of manufacture fairly falling within the scope of the appended claims either literally or under the doctrine of equivalents.

The invention claimed is:

1. A lumber handling method for retrieving a plurality of boards of various sizes from a plurality of stations supported by a floor, the plurality of stations include at least a first station, the plurality of boards includes at least a board, the lumber handling method comprising:

placing the board right-side-up at the first station;

using a trolley for transferring the board in a forward direction from the first station toward a board receiving area, the forward direction being substantially perpendicular to a length of the board;

defining a predetermined positive limit of curvature;

detecting whether the board has a board curvature exceeding the predetermined positive limit of curvature;

before cutting a board segment from the board, determining whether to turn the board up-side-down based on whether the board curvature exceeds the predetermined positive limit of curvature;

using the saw for cutting the board into the board segment with the board right-side-up if the board curvature is less than the predetermined positive limit of curvature, wherein the board segment is shorter than the board with reference to the length of the board;

mechanically turning the board up-side-down and using the saw for cutting the board into the board segment with the board up-side-down if the board curvature exceeds the predetermined positive limit of curvature; and assembling a structural board assembly incorporating the board segment.

2. The lumber handling method of claim 1, further comprising:

defining a designated location of the board segment for use in the structural board assembly; and before cutting the board segment from the board, determining whether to turn the board up-side-down based further on the designated location of the board segment in the structural board assembly.

3. The lumber handling method of claim 1, wherein the structural board assembly is a truss.

4. The lumber handling method of claim 1, further comprising:

generating a plurality of edge readings by sensing a plurality of points along the edge of the board with a plurality of sensors that are spaced apart along the length of the board; and based on the plurality of edge readings, determining whether the board curvature exceeds the predetermined positive limit of curvature.

5. The lumber handling method of claim 4, further comprising:

calibrating the plurality of sensors by positioning a standard elongate member within sensing proximity of the plurality of sensors;

generating a plurality of test readings by sensing a plurality of test points along the standard elongate member; and referring to the plurality of test readings to compensate for possible linear misalignment of the plurality of sensors.

6. The lumber handling method of claim 5, wherein the standard elongate member is a substantially straight board.

7. The lumber handling method of claim 5, wherein the plurality of sensors includes a plurality of laser emitters.

8. The lumber handling method of claim 5, wherein the plurality of sensors includes a plurality of electromechanical switches.

9. The lumber handling method of claim 1, further comprising:

if the board has a convex edge, automatically applying a mark on the convex edge of the board.

10. The lumber handling method of claim 1, further comprising:

if the board has a concave edge, automatically applying a mark on the concave edge of the board.

11. The lumber handling method of claim 1, further comprising:

if the board is curved, automatically applying a first mark on a convex edge of the board and applying a second mark on a concave edge of the board, wherein the second mark is distinguishable from the first mark.

12. A lumber handling method for retrieving a plurality of boards of various sizes from a plurality of stations supported by a floor, the plurality of stations include at least a first station, the plurality of boards includes at least a board, the lumber handling method comprising:

placing the board right-side-up at the first station;

using a trolley for transferring the board in a forward direction from the first station toward a board receiving area, the forward direction being substantially perpendicular to a length of the board;

defining a predetermined positive limit of curvature;

detecting whether the board has a board curvature exceeding the predetermined positive limit of curvature;

determining whether to cut the board in a first direction or a second direction based on whether the board curvature exceeds the predetermined positive limit of curvature, wherein the first direction deviates from the second direction;

using the saw for cutting the board in the first direction to create a board segment if the board curvature is less than the predetermined positive limit of curvature;

using the saw for cutting the board in the second direction to create the board segment if the board curvature exceeds the predetermined positive limit of curvature; and assembling a structural board assembly incorporating the board segment.

13. The lumber handling method of claim 12, wherein the structural board assembly is a truss.

14. The lumber handling method of claim 12, further comprising:

generating a plurality of edge readings by sensing a plurality of points along the edge of the board with a plurality of sensors that are spaced apart along the length of the board; and based on the plurality of edge readings, determining whether the board curvature exceeds the predetermined positive limit of curvature.

15. The lumber handling method of claim 14, wherein the plurality of sensors includes a plurality of laser emitters.

16. The lumber handling method of claim 14, further comprising:

calibrating the plurality of sensors by positioning a standard elongate member within sensing proximity of the plurality of sensors;

generating a plurality of test readings by sensing a plurality of test points along the standard elongate member; and referring to the plurality of test readings to compensate for possible linear misalignment of the plurality of sensors.

17. The lumber handling method of claim 16, wherein the standard elongate member is a substantially straight board.

18. A lumber handling method for retrieving a plurality of boards of various sizes from a plurality of stations supported by a floor, the plurality of stations include at least a first station, the plurality of boards includes at least a board, the lumber handling method comprising:

placing the board right-side-up at the first station;

using a trolley for transferring the board in a forward direction from the first station toward a board receiving area, the forward direction being substantially perpendicular to a length of the board;

defining a predetermined positive limit of curvature;

detecting whether the board has a board curvature exceeding the predetermined positive limit of curvature;

if the board curvature exceeds the predetermined positive limit of curvature, automatically applying a first mark on the board that distinguishes a convex edge of the board from a concave edge of the board;

if the board curvature exceeds the predetermined positive limit of curvature, cutting the board with a saw to create a board segment that includes the first mark; and assembling a structural board assembly incorporating the board segment.

19. The lumber handling method of claim 18, wherein the first mark is applied to the convex edge of the board if the board curvature exceeds the predetermined positive limit of curvature.

20. The lumber handling method of claim 19, further comprising:

if the board curvature exceeds the predetermined positive limit of curvature, applying a second mark to the concave edge of the board, the second mark being distinguishable from the first mark.

* * * * *